US007341326B2

(12) United States Patent
Kondo et al.

(10) Patent No.: US 7,341,326 B2
(45) Date of Patent: Mar. 11, 2008

(54) IMAGE FORMING APPARATUS AND METHOD OF CONTROLLING IMAGE FORMING APPARATUS

(75) Inventors: Shunsaku Kondo, Ibaraki (JP); Masatoshi Tanabe, Ibaraki (JP); Toshio Hayashi, Ibaraki (JP); Yoshihiro Funamizu, Chiba (JP); Keizo Isemura, Tokyo (JP); Mitsushige Murata, Chiba (JP); Junichi Into, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 385 days.

(21) Appl. No.: 10/875,201

(22) Filed: Jun. 25, 2004

(65) Prior Publication Data

US 2005/0024393 A1 Feb. 3, 2005

(30) Foreign Application Priority Data

Jul. 28, 2003 (JP) ..... 2003-202589
Dec. 3, 2003 (JP) ..... 2003-405027

(51) Int. Cl.
*B41J 29/393* (2006.01)

(52) U.S. Cl. ..... 347/19; 347/2; 347/4

(58) Field of Classification Search ..... 347/2, 347/51, 16, 19, 4; 101/2; 235/492
See application file for complete search history.

(56) References Cited

U.S. PATENT DOCUMENTS 5,710,959 A 1/1998 Hirooka et al. ..... 399/88
5,867,279 A 2/1999 Funamizu et al. ..... 358/296
5,905,581 A 5/1999 Suzuki et al. ..... 358/468
5,923,919 A 7/1999 Nimura et al. ..... 399/37
5,974,171 A 10/1999 Hayashi et al. ..... 382/162
6,827,279 B2 * 12/2004 Teraura ..... 235/492
2002/0170973 A1 11/2002 Teraura ..... 235/492
2003/0061947 A1 * 4/2003 Hohberger et al. ..... 101/2

FOREIGN PATENT DOCUMENTS

JP 59-036867 2/1984
JP 2002-337426 11/2002

* cited by examiner

*Primary Examiner*—Lam Son Nguyen
(74) *Attorney, Agent, or Firm*—Fitzpatrick, Cella, Harper & Scinto

(57) ABSTRACT

An image forming apparatus by which an image formed on a printing medium by image forming means on the basis of image data can be related to the image data includes a controller which prepares management information corresponding to the image data, and controls an operation of the image forming means in accordance with the management information, an adhering unit which adheres, to the printing medium on which the image is formed by the image forming means, a radio identification tag having a transmitting/receiving unit capable of transmitting/receiving data by radio communication, and a data holding unit capable of holding the data, and a communicating module which writes, in the data holding unit of the radio identification tag adhered on the printing medium, the management information for relating the image on the printing medium to the image data, by communicating with the transmitting/receiving unit by radio.

15 Claims, 26 Drawing Sheets

IMAGE FORMING APPARATUS AND METHOD OF CONTROLLING IMAGE FORMING APPARATUS

FIELD OF THE INVENTION

The present invention relates to an image formation technique and, more particularly, to an image forming apparatus, which forms an image by transferring, onto a printing medium, a toner image formed on a latent image carrier by, for example, an electrophotographic method or electrostatic printing method, or an image forming apparatus which directly forms an image on a printing medium by an inkjet printing method, and a method of controlling the image forming apparatus.

BACKGROUND OF THE INVENTION

In an electrophotographic image forming apparatus which forms a copied image by transferring a toner latent image formed on a transfer medium onto printing media such as plain paper sheets stored in a paper feed unit, and thermally fixes the transferred toner latent image, it is important to manage image information having undergone copied image formation, in order to browse and reuse the information concerning the copied image. When image information of a copy source is digital data, various pieces of attached information such as the importance, author/owner, formation date, and keyword of the image information can be collectively managed together with the image information by, for example, forming a database from the image information. This method allows easy retrieval and update of the image information, and hence is effective to browse and reuse the information (for example, Japanese Patent Laid-Open No. 59-036867).

On the other hand, management which relates information to an object by using an RFID (Radio Frequency Identification) tag (to be referred to as a "radio identification tag" hereinafter) is also attracting attention. For example, Japanese Patent Laid-Open No. 2002-337426 is a technique which applies a printing medium to a copying machine or printer by attaching a radio identification tag to the medium.

Unfortunately, if the original data is not digital data but image information printed on a sheet-like paper medium (to be referred to as a "paper sheet" hereinafter), or if image information is obtained by printing digital data on a printing medium by an image forming apparatus, no attached information as described above can be related to the image information any longer. Therefore, these pieces of information cannot be collectively managed by a digital information database. This makes it very difficult to browse or reuse information concerning printed image information.

For example, when image information is once printed on a printing medium on the basis of digital data, the original digital data cannot be retrieved from the medium unless information for retrieving the digital data is present. Accordingly, to reuse the printed image information as digital data, this image information printed on the medium must be digitized again. Furthermore, if the original digital data is changed or modified by editing later, the result of editing cannot be reflected on the image information printed before editing. In this case, therefore, the printed image information must be digitized again and edited again. This imposes a repetitive operation burden on an operator.

Also, even when a radio identification tag is used, a read/write tag by which data can be read out from and written in a memory is still expensive compared to a read-only tag (u chip) by which it is only possible to read out data stored in a memory in advance. Additionally, using a radio identification tag by attaching it to a printing medium beforehand poses many problems in respect of the reliability.

For example, when a printing medium is passed through a fixing device in an image forming apparatus which forms an image by transferring a toner image onto the printing medium, a radio identification tag is placed in a high-temperature environment together with the printing medium. Consequently, a device forming the radio identification tag may be physically destroyed, or may cause dielectric breakdown by a high electric field applied during, for example, transfer inside the image forming apparatus and may become unable to operate. That is, image formation with a radio identification tag attached to a printing medium beforehand is difficult in respect of the reliability of the radio identification tag. Also, generally no printing media having radio identification tags attached to them have spread yet, so it is presently difficult to specially order and prepare such printing media in advance.

Accordingly, it is important to use a printing medium normally put on the market, and attach a radio identification tag to this printing medium so that the reliability of the radio identification tag can be maintained.

SUMMARY OF THE INVENTION

The present invention has been proposed to solve the conventional problems, and has as its object to provide an image formation technique capable of unitary management of image data, and capable of, for example, retrieving and reusing the image data. The present invention principally has the following arrangements.

The above-described object of the present invention is achieved by an image forming apparatus by which an image formed on a printing medium by image forming means on the basis of image data can be related to the image data, comprising:

control means for preparing management information corresponding to the image data, and controlling an operation of the image forming means in accordance with the management information;

adhering means for adhering, to the printing medium on which the image is formed by the image forming means, a radio identification tag having a transmitting/receiving unit capable of transmitting/receiving data by radio communication, and a data holding unit capable of holding the data; and communicating means for writing, in the data holding unit of the radio identification tag adhered on the printing medium, the management information for relating the image on the printing medium to the image data, by communicating with the transmitting/receiving unit by radio.

Furthermore, the above-described object of the present invention is achieved by a method of controlling an image forming apparatus by which an image formed on a printing medium by image forming means on the basis of image data can be related to the image data, comprising:

a control step of preparing management information corresponding to the image data, and controlling an operation of the image forming means in accordance with the management information;

an adhesion step of adhering, to the printing medium on which the image is formed by the image forming means, a radio identification tag having a transmitting/receiving unit capable of transmitting/receiving data by radio communication, and a data holding unit capable of holding the data; and a communication step of writing, in the data holding unit of the radio identification tag adhered on the printing medium, the management information for relating the image on the printing medium to the image data, by communicating with the transmitting/receiving unit by radio.

Furthermore, the above-described object of the present invention is achieved by a control program of an image forming apparatus by which an image formed on a printing medium by image forming means on the basis of image data can be related to the image data, comprising:

a control module which prepares management information corresponding to the image data, and controls an operation of the image forming means in accordance with the management information;

an adhering module which adheres, to the printing medium on which the image is formed by the image forming means, a radio identification tag having a transmitting/receiving unit capable of transmitting/receiving data by radio communication, and a data holding unit capable of holding the data; and a communicating module which writes, in the data holding unit of the radio identification tag adhered on the printing medium, the management information for relating the image on the printing medium to the image data, by communicating with the transmitting/receiving unit by radio.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 19B is a timing chart showing the relationship between a light amount detection signal (reflected light), count clock signal, and the like;

DETAILED DESCRIPTION OF THE PREFERRED EMBODIMENTS

Preferred embodiments of the present invention will now be described in detail in accordance with the accompanying drawings.

First Embodiment

Figure 1:
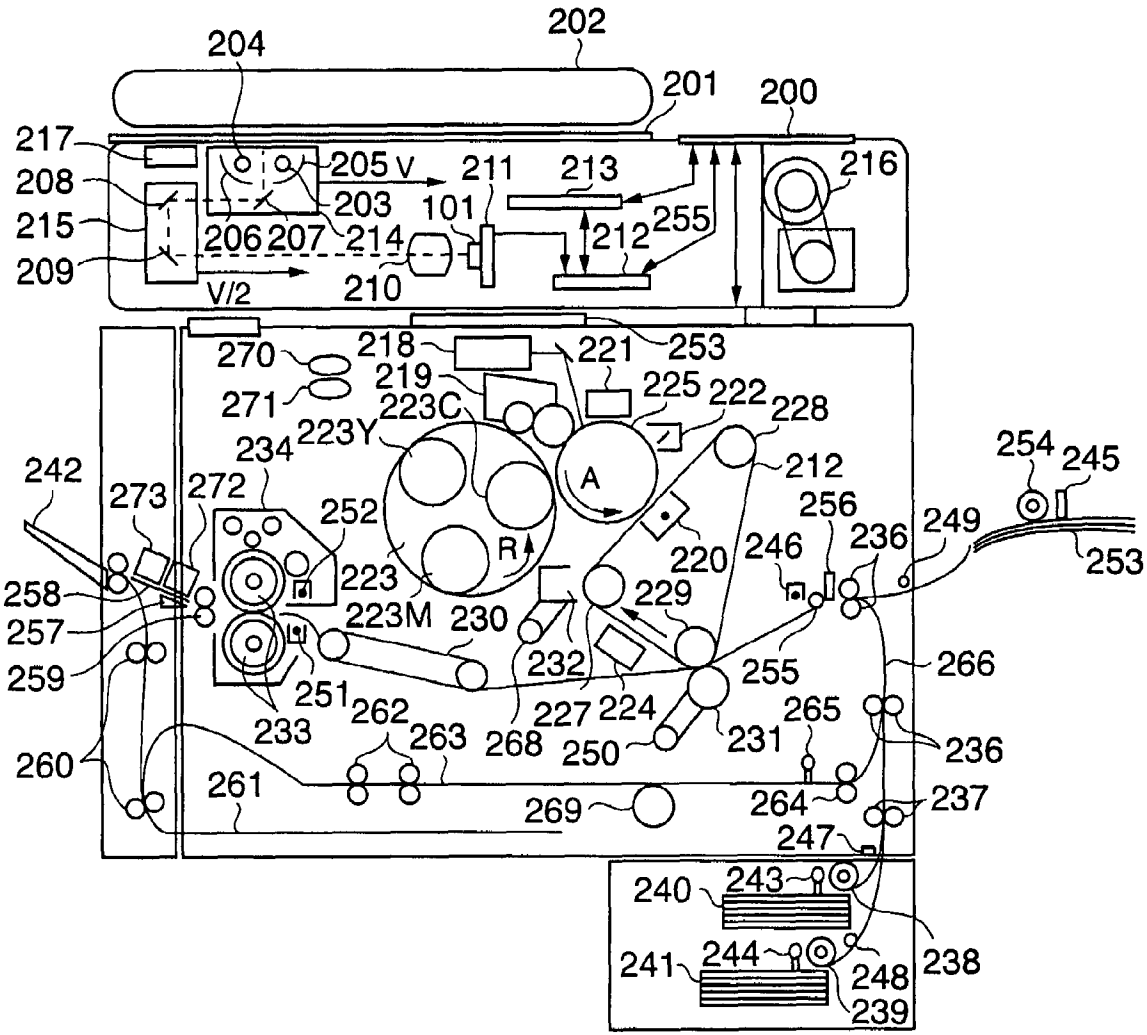
FIG. 1 is a view showing the overall arrangement of an image forming apparatus according to an embodiment of the present invention.
Figure 2:
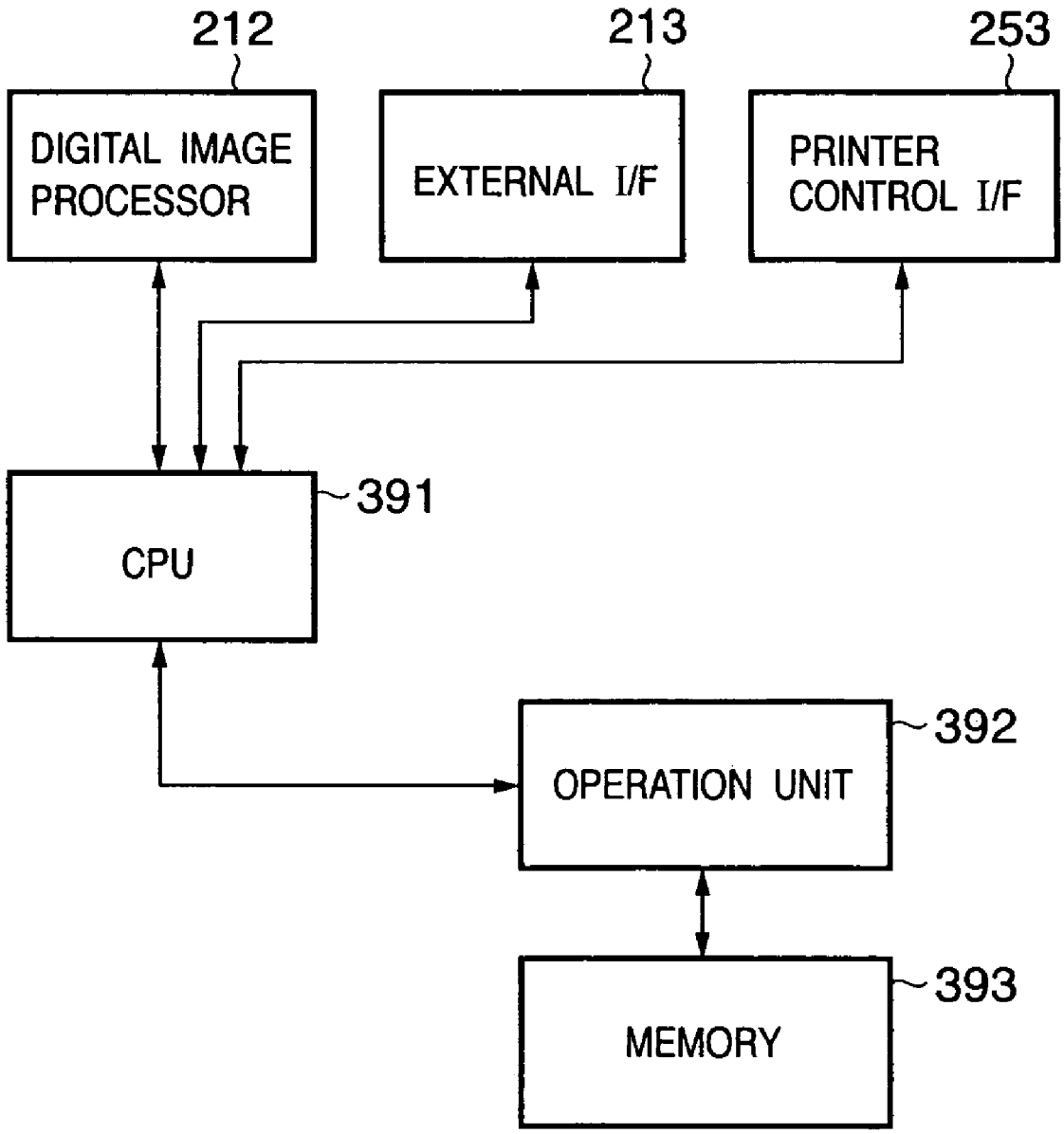
FIG. 2 is a block diagram showing the arrangement of a controller 200.
Figure 3:
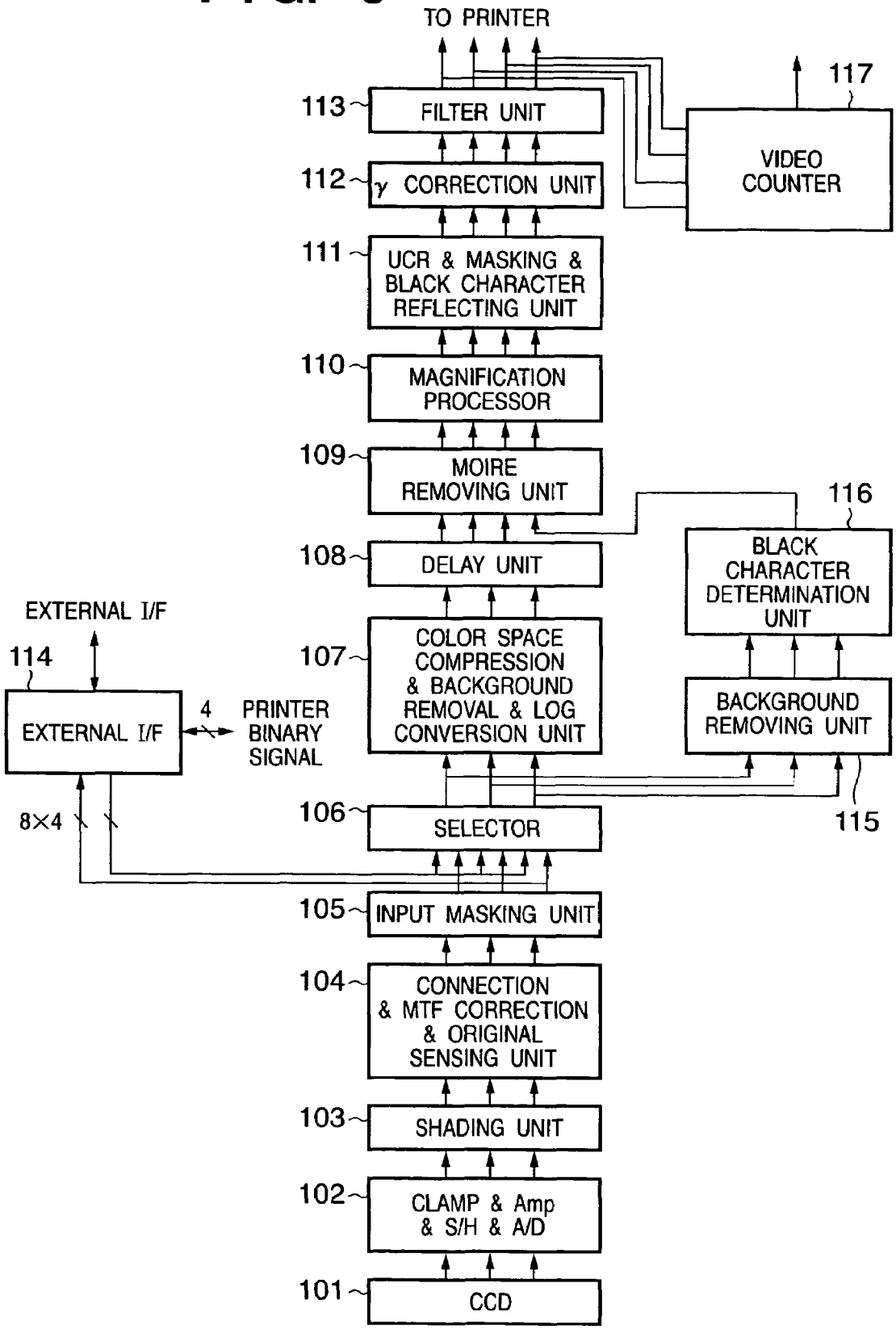
FIG. 3 is a block diagram showing details of the arrangement of a digital image processor 212.

FIGS. 1 to 3 are views for explaining the arrangement of an image forming apparatus to which an image formation technique provided by the present invention is applied. The basic configurations will be explained below with reference to FIGS. 1 to 3.

<Arrangement of Color Reader>

First, the arrangement of a color reader will be described below. FIG. 1 is a view showing the overall arrangement of the image forming apparatus. In FIG. 1, reference numeral 101 denotes a CCD which is an image sensing element; 211, a substrate on which the CCD 101 is mounted; 200, a controller which controls the whole image forming apparatus; 212, a digital image processor; 201, an original glass plate (platen); and 202, a document feeder (DF) (a mirror-surface press plate may also be used instead of the document feeder 202).

Reference numerals 203 and 204 denote light sources (halogen lamps or fluorescent lamps) for illuminating an original; 205 and 206, reflectors for condensing light from the light sources 203 and 204 onto an original; 207 to 209, mirrors; 210, a lens for focusing reflected light from an original or projected light onto the CCD 101; and 214, a carriage which houses the light sources (203 and 204), reflectors (205 and 206), and mirror 207.

Reference numeral 215 denotes a carriage which houses the mirrors 208 and 209; and 213, an external interface (I/F) for interfacing with another device. Note that the carriages 214 and 215 mechanically move at velocity V and velocity V/2, respectively, in directions (indicated by the arrows) perpendicular to the electrical scanning (main scanning) direction of the CCD 101, thereby scanning (sub-scanning) the entire surface of an original.

As shown in FIG. 2, the controller 200 is made up of an operation unit 392 and memory 393 which exchange, via a CPU 391, control information with the digital image processor 212, the external I/F 213, and a printer control I/F 253. The operation unit 392 includes a liquid crystal display with a touch panel for allowing an operator to input the contents of processing, or notifying the operator of information concerning processing, warning, and the like. The memory 393 can store original image data of image formation, as data for determining whether image formation is normally executed. By comparing this data with data of an image formed on a printing medium discharged from the image forming apparatus, whether image formation is normally completed can be determined. This processing will be explained in detail later in the second embodiment.

Figure 4:
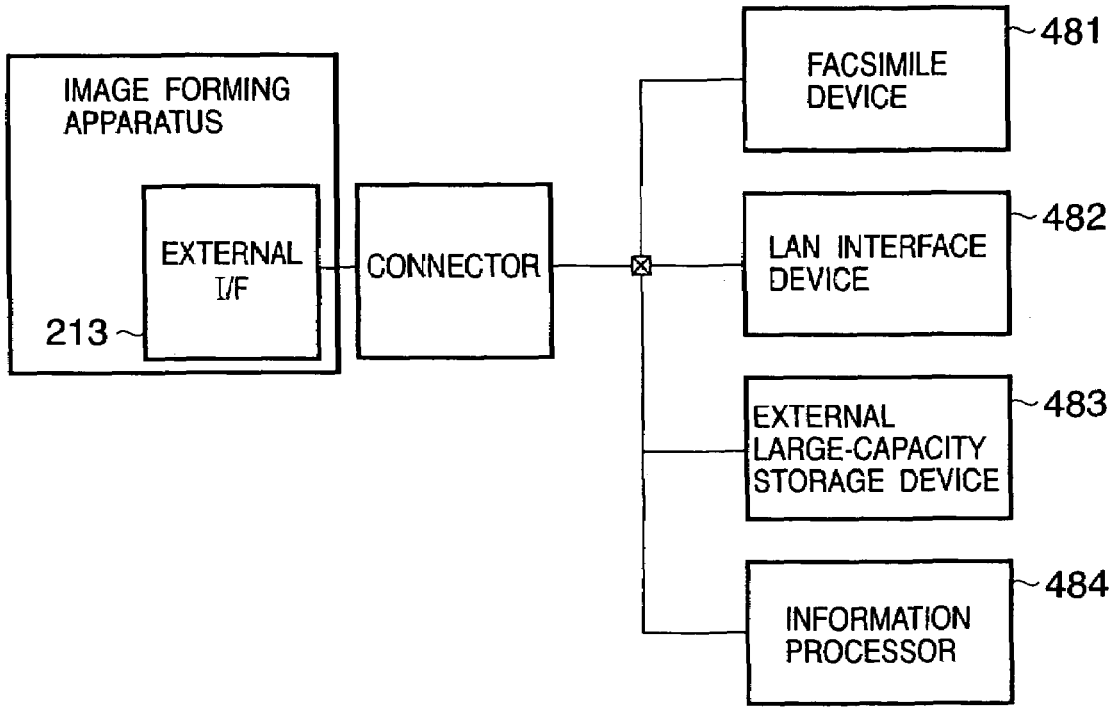
FIG. 4 is a view for explaining the arrangement of an external device to be connected to the image forming apparatus.

The external I/F 213 is an interface for exchanging image data, code information, and the like with devices outside the image forming apparatus. More specifically, as shown in FIG. 4, the external I/F 213 can connect to a facsimile device 481, LAN interface device 482, external large-capacity storage device 483, and the like. Note that communication of image data, code information, and the like and control of the communication between the facsimile device 481, LAN interface device 482, and external large-capacity storage device 483 are performed by mutual communication between the facsimile device 481, LAN interface device 482, and external large-capacity storage device 483 as the connected devices and the CPU 391 of the controller 200.

A radio identification tag information receiver 217 for performing radio communication with a radio identification tag, as the characteristic feature of this embodiment, which is adhered to an original as a printing medium is placed below the original glass plate 201. Details of the radio identification tag information receiver 217 will be described later.

<Digital Image Processor>

Next, the digital image processor 212 will be explained in detail below. FIG. 3 is a block diagram showing details of the arrangement of the digital image processor 212. An original on the original glass plate 201 reflects light from the light sources (203 and 204), and the reflected light is guided to the CCD 101 and converted into an electrical signal. When the CCD 101 is a color sensor, this color sensor can be a 1-line CCD on which R, G, and B color filters are arranged in line in the order of R, G, and B, or a 3-line CCD on which R, G, and B filters are arranged on different CCDs. Filters may also be mounted on a chip, or separated from CCDs.

The electrical signal (analog image signal) is input to the image processor 212. A clamp & Amp. & S/H & A/D unit 102 samples and holds (S/H) the analog image signal, clamps the dark level of the analog image signal to a reference voltage, amplifies the signal to a predetermined amount (these processes are not necessarily performed in the order named), and A/D-converts the signal to, for example, a digital signal having 8 bits for each of R, G, and B.

This RGB signal undergoes shading correction and black correction performed by a shading unit 103. The corrected RGB signal is further processed by a connection & MTF correction & original sensing unit 104. When the CCD 101 is a 3-line CCD, read positions between lines (R, G, and B lines) are different. Therefore, a connection process is so performed as to adjust the delay amount of each line in accordance with the read rate, and correct the read timings such that the read positions of the three lines are the same. In MTF correction, the MTF of read changes in accordance with the read rate or magnification, so this change is corrected. In original sensing, the original size is sensed by scanning an original on the original glass plate 201. The digital signal having the corrected read position timings is input to an input masking unit 105. The input masking unit 105 corrects the spectral characteristics of the CCD 101, and the spectral characteristics of the light sources (203 and 204) and reflectors (205 and 206).

The output from the input masking unit 105 is input to a selector 106 capable of switching between this output and an external I/F signal. The output signal from the selector 106 is input to a color space compression & background removal & LOG conversion unit 107 and background removing unit 115. After the background is removed from the input signal to the background removing unit 115, the signal is input to a black character determination unit 116 which determines whether there is a black character in the original, thereby generating a black character signal from the original.

Also, the color space compression & background removal & LOG conversion unit 107 which has received the output from the selector 106 determines, by color space compression, whether the read image signal falls within the range reproducible by a printer. If the image signal falls within this range, no correction is performed for the signal. If the image signal falls outside the range, the signal is so corrected as to fall within the range reproducible by a printer. A background removal process is then performed, and the RGB signal is converted into a CMY signal by LOG conversion. The timing of the output signal from the color space compression & background removal & LOG conversion unit 107 is adjusted by a delay unit 108, so that this output signal is timed with the signal generated by the black character determination unit 116.

Moire is removed from these two types of signals by a moire removing unit 109, and the signals are magnified in the main scanning direction by a magnification processor 110. Reference numeral 111 denotes a UCR & masking & black character reflecting unit. Of the signals processed by the magnification processor 110, the CMY signal undergoes a UCR process to generate a CMYK signal, and this CMYK signal is corrected into a signal matching the output from a printer by the masking processor. Also, the determination signal generated by the black character determination unit 116 is fed back to the CMYK signal. The signal thus processed by the UCR & masking & black character reflecting unit 111 undergoes density adjustment in a γ correction unit 112, and smoothing or edge processing in a filter unit 113.

<Arrangement of Printer>

Referring back to FIG. 1, the arrangement of a printer as an example of the image forming apparatus will be described below. A photosensitive drum (to be simply referred to as a "photoreceptor" hereinafter) 225 as an image carrier can be rotated in the direction of an arrow A by a motor (not shown). Around the photoreceptor 225, a primary charger 221, exposure device 218, black developing unit 219, color developing unit 223, transfer charger 220, and cleaner 222 are arranged.

The black developing device 219 is a developing device for monochromatic development, and develops a latent image on the photoreceptor 225 by black (K) toner. The color developing unit 223 has three developing devices 223Y, 223M, and 223C for full-color development. The developing devices 223Y, 223M, and 223C develop the latent image on the photoreceptor 225 by yellow (Y), magenta (M), and cyan (C) toners, respectively. To develop the toner of each color, the developing unit 223 is rotated in the direction of an arrow R by a motor (not shown), and a developing device of the color is aligned in contact with the photoreceptor 225.

The thus developed toner images of the different colors on the photoreceptor 225 are sequentially transferred onto a belt 212 as an intermediate transfer medium by the transfer charger 220, and thereby the toner images of the four colors are overlayed on each other. The belt 212 is looped between rollers 227, 228, and 229. The roller 227 is coupled with a driving source (not shown) to function as a driving roller for driving the belt 212. The roller 228 functions as a tension roller for adjusting the tension of the belt 212. The roller 229 functions as a backup roller of a transfer roller 231 as a secondary transfer device.

A transfer roller attaching/detaching unit 250 is a driving unit for attaching the transfer roller 231 to the belt 212, or detaching the transfer roller 231 from the belt 212. A belt cleaner 232 is so positioned as to face the roller 227 on the other side of the belt 212. A belt cleaner attaching/detaching unit 268 is a driving unit for attaching the belt cleaner 232 to the belt 212, or detaching the belt cleaner 232 from the belt 212. When the belt cleaner 232 is operated in the attaching direction by the belt cleaner attaching/detaching unit 268, any remaining toner on the belt 212 is scraped off by a blade.

Printing media stored in cassettes (240 and 241) and a manual paper feed unit 253 are fed to a nip portion (for example, a contact portion between the transfer roller 231 and belt 212 by paper feed roller pairs 235, 236, and 237). During this feeding, the transfer roller 231 is urged against the belt 212 by driving the transfer roller attaching/detaching unit 250 in the urging direction. The toner images formed on the belt 212 are transferred onto a printing medium in this nip portion, thermally fixed by a fixing device 234, and discharged outside the apparatus.

Note that the cassettes (240 and 241) and manual paper feed unit 253 have sheet absence sensors (243, 244, and 245) for sensing the presence/absence of a printing medium. Note also that the cassettes (240 and 241) and manual paper feed unit 253 have paper feed sensors (247, 248, and 249) for sensing a pickup error of a printing medium.

<Image Formation Process>

The color printer having the above arrangement executes image formation as follows. First, a printing medium conveying operation in the paper feed section will be explained below.

The printing media stored in the cassettes (240 and 241) and manual paper feed unit 253 are conveyed one by one onto a paper feed path 266 by pickup rollers (238, 239, and 254). When each printing medium on the paper feed path 266 is conveyed to a registration roller 255 by the paper feed roller pairs (235, 236, and 237), the passing of this printing medium is sensed by a registration sensor 256 immediately before the registration roller 255. In this embodiment, when the passing of the printing medium is thus sensed by the registration sensor 256, the conveying operation is once interrupted after an appropriate time has elapsed.

As a consequence, the conveyed printing sheet abuts against the stopped registration roller 255, and the conveyance is stopped. In this state, position correction is performed such that the end portion in the advancing direction of the printing medium is perpendicular to the convey path. That is, if an oblique motion is caused because the conveying direction of the printing medium deviates from the convey path, the position of the printing medium is corrected with respect to the conveying direction of the convey path. This process is normally called paper feed registration. The paper feed registration is an essential process to minimize a skew of the printing medium in the image forming direction after that. After this paper feed registration, the registration roller 255 is activated to supply the printing medium to the secondary transfer device (transfer roller 231).

A procedure of forming an image on the printing medium supplied to the secondary transfer device 231 will be explained below. First, a voltage is applied to the charger 221 to negatively charge the surface of the photoreceptor 225 evenly with a predetermined charger potential. Subsequently, the exposure device 218 which is a laser scanner performs exposure such that an image portion on the charged photoreceptor 225 is set at a predetermined exposure unit potential, thereby forming a latent image. That is, the exposure device 218 is turned on and off on the basis of an image signal to form a latent image corresponding to an image.

A developing bias preset for each color is applied to a corresponding developing roller of the black developing device 219 and color developing device 223. When passing by the position of this developing roller, the latent image is developed by toner and visualized as a toner image. This toner image is transferred onto the belt 212 by the transfer device 220. The secondary transfer device 231 transfers this toner image onto the printing medium conveyed by the paper feed section. After that, the printing medium is conveyed to the fixing device 234 via a fixing conveyor belt 230.

In the fixing device 234, the toner image is charged by pre-fixing chargers (251 and 252) in order to prevent image disturbance by compensating for the adsorption power of toner. The toner image is then thermally fixed by a fixing roller 233. After that, the convey path is switched to a paper discharge path 258 by a paper discharge flapper 257, and the printing medium is discharged onto a paper discharge tray 242.

In this state, a radio identification tag adhering device 272 can adhere a radio identification tag to the printing medium, and a radio identification tag information writing device 273 can write various image information on the radio identification tag. The arrangement and processing of the radio identification tag are the characteristic features of this embodiment, and the details will be explained later.

In full-color printing, the four color toners are overlayed on each other on the belt 212, and then transferred onto the printing medium. After the charge of toners remaining on the photoreceptor 225 is so changed as to allow easy cleaning by a pre-cleaning device (not shown), the remaining toners are removed and collected by the cleaner 222. Finally, the charge of the photoreceptor 225 is evenly removed to nearly 0 V by a charge removing device (not shown), thereby preparing for the next image formation cycle.

The image formation timings of the color printer described above are controlled on the basis of a predetermined position on the belt 212. The belt 212 is looped between rollers, which are the driving roller 227, tension roller 228 and backup roller 229; and the belt 212 is given a predetermined tension by the tension roller 228.

A reflecting sensor 224 for sensing the reference position is placed between the driving roller 227 and backup roller 229. The reflecting sensor 224 senses a marking such as a reflection tape adhered to the edge of the outer circumferential surface of the belt 212, and outputs an I-top signal for sensing the reference position.

The ratio of the length of the outer circumferential surface of the photoreceptor 225 to the circumferential length of the belt 212 is an integral ratio represented by 1: n (n is an integer). When these lengths are set like this, while the belt 212 rotates once the photoreceptor 225 rotates an integral number of times to return to exactly the same state as before the belt 212 rotates once. Therefore, while the four colors are overlayed on each other on the intermediate transfer belt 212 (while the belt 212 rotates four times), it is possible to avoid color misregistration caused by uneven rotation of the photoreceptor 225.

In the intermediate transfer type image forming apparatus as described above, when a predetermined time has elapsed after the I-top signal is sensed, the exposure device 218 which is a laser scanner starts exposure. Also, as described above, while the belt 212 rotates once, the photoreceptor 225 rotates an integral number of times to return to exactly the same state as before the belt 212 rotates once. Accordingly, toner images are always formed in the same position on the belt 212. Although toner image sizes change in accordance with sheet sizes, a range within which no toner images are formed is always present on the belt 212.

Also, the belt 212 has a belt length with which, if the sheet size of an image is short, two toner images of the image can be formed. Especially when a four-color image is to be formed, two images can be formed during a time period in which the belt rotates only four times. This improves the productivity.

An operation of forming an image on the lower surface of a printing medium will be described below. When an image is to be formed on the lower surface of a printing medium, image formation on the upper surface of the printing medium is executed first. This operation of forming an image on the upper surface is already described in detail above, so an explanation thereof will be omitted. If image formation need only be performed on the upper surface, after this image formation is performed, the toner image is thermally fixed by the fixing device 234. Then, the convey path is switched to the paper discharge path 258 by the paper discharge flapper 257, and the printing medium is discharged onto the paper discharge tray 242. However, if image formation is to be successively performed on the lower surface, the convey path is switched to a lower surface path 259 by the paper discharge flapper 257, and a reversal roller 260 is rotated in synchronism with this switching to once convey the printing medium into a double-side reversal path 261. After that, the printing medium is conveyed into the double-side reversal path 261 by the width in the feeding direction of the sheet medium. Then, the advancing direction is switched by a double-side reversal path guide 269 in accordance with the reverse rotation of the reversal roller and the rotation of a double-side path conveyor roller 262. Consequently, the printing medium is conveyed to a double-side path 263 with the upper surface on which the image is formed facing down.

Subsequently, the printing medium is conveyed on the double-side path 263 toward paper refeed rollers 264, and this passage of the printing medium is sensed by a paper refeed sensor 265 immediately before the paper refeed rollers 264. In this embodiment, when an appropriate time has elapsed after the passing of the printing medium is thus sensed by the paper refeed sensor 265, the conveying operation is once interrupted. As a result, the printing medium abuts against the stopped paper refeed rollers 264, and the conveyance is temporarily stopped. In this state, position correction is performed such that the end portion in the advancing direction of the printing medium is perpendicular to the convey path. That is, if a ramp is caused because the conveying direction of the printing medium deviates from the convey path in the paper refeed path, the conveying direction of the paper refeed path is corrected. This process is normally called paper refeed registration. The paper refeed registration is an essential process to minimize a skew of the lower surface of the printing medium in the image forming direction after that.

After this paper refeed registration, the paper refeed rollers 264 are activated to convey the printing medium, which is turned upside down, on the paper feed path 266 again. An image forming operation after that is the same as the image forming operation for the upper surface described above, so an explanation thereof will be omitted. The printing medium having images thus formed on both the upper and lower surfaces is conveyed as the convey path is switched to the paper discharge path 258 by the paper discharge flapper 257, and discharged onto the paper discharge tray 242. In this embodiment in which the above operation is performed, images can be automatically formed on both the surfaces of a sheet medium without causing an operator to turn the sheet medium upside down.

<Radio Identification Tag>

Figure 5:
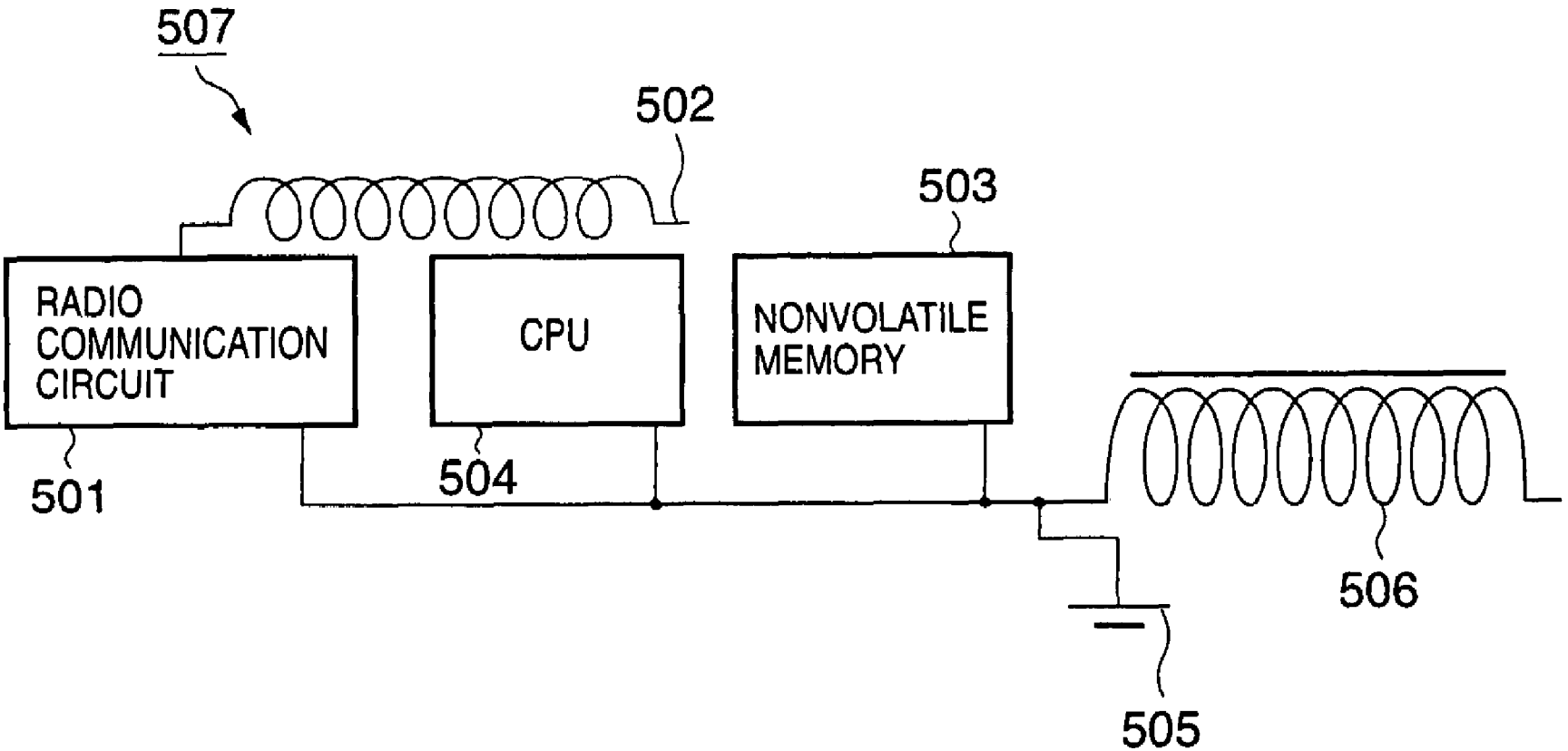
FIG. 5 is a view for explaining the internal arrangement of a radio identification tag.

The arrangement of a radio identification tag which can be adhered to a printing medium applied in this embodiment, and can hold information for managing image data will be described below with reference to FIGS. 5 and 6. FIG. 5 is a view for explaining the internal arrangement of the radio identification tag. A radio identification tag 507 has a radio communication circuit 501, antenna circuit 502, nonvolatile memory 503, CPU 504, battery circuit 505, and power generating circuit 506. By using the radio communication circuit 501 and antenna circuit 502, information can be exchanged with external devices by radio communication.

Radio information received from the radio identification tag information writing device 273 is recorded in the nonvolatile memory 503. The radio communication circuit 501 and antenna circuit 502 can transmit various information recorded in the nonvolatile memory 503 to the radio identification tag information receiver 217. The CPU 504 controls the overall radio communication. That is, the radio communication circuit 501, nonvolatile memory 503, and the like are controlled by the CPU 504.

The radio communication circuit 501, nonvolatile memory 503, and CPU 504 operate by receiving power from the battery circuit 505 or power generating circuit 506. The power generating circuit 506 is a coil-like electric circuit capable of generating electric power by self-generation by using electromagnetic induction between the power generating circuit 506 and the external device (273 or 217). In this embodiment, the radio identification tag 507 (a circuit having the components 501 to 506) can be formed as a low-profile, microcircuit unit. FIG. 6 is a view showing the state in which the circuit of the radio identification tag 507 is deposited on a film 610. The radio identification tag 507 can be adhered to a staple for stapling a printing sheet medium or to the medium itself via the film 610.

Figure 6:
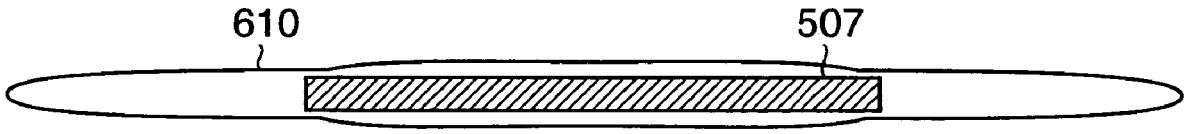
FIG. 6 is a view showing the state in which a circuit of the radio identification tag is deposited on a film.
Figure 7A:
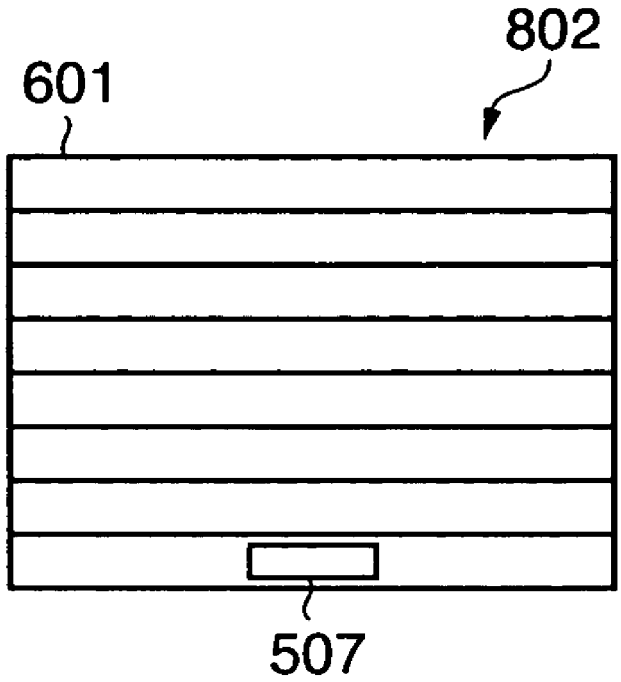
FIG. 7A is a plan view showing the state in which the radio identification tag is adhered to a staple.
Figure 7B:
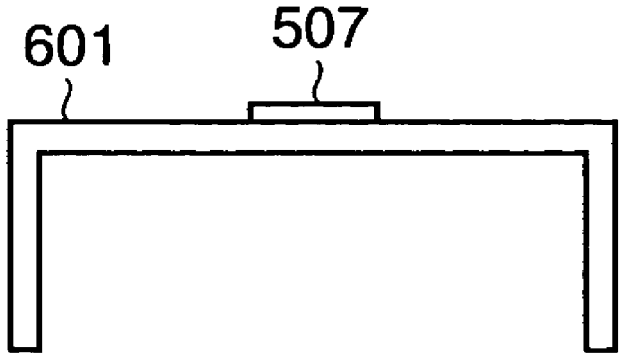
FIG. 7B is a sectional view showing the staple to which the radio identification tag is adhered.

FIG. 7A is a plan view showing the state in which the radio identification tag 507 is adhered to a staple 601 via the film 610 shown in FIG. 6. FIG. 7B is a sectional view showing the staple 601 on which the radio identification tag 507 is adhered. By using this staple having the radio identification tag 507 adhered, the radio identification tag can be attached to a paper sheet such as a printing medium. Note that FIGS. 7A and 7B illustrate the state before the staple is attached to a printing medium.

Figure 8:
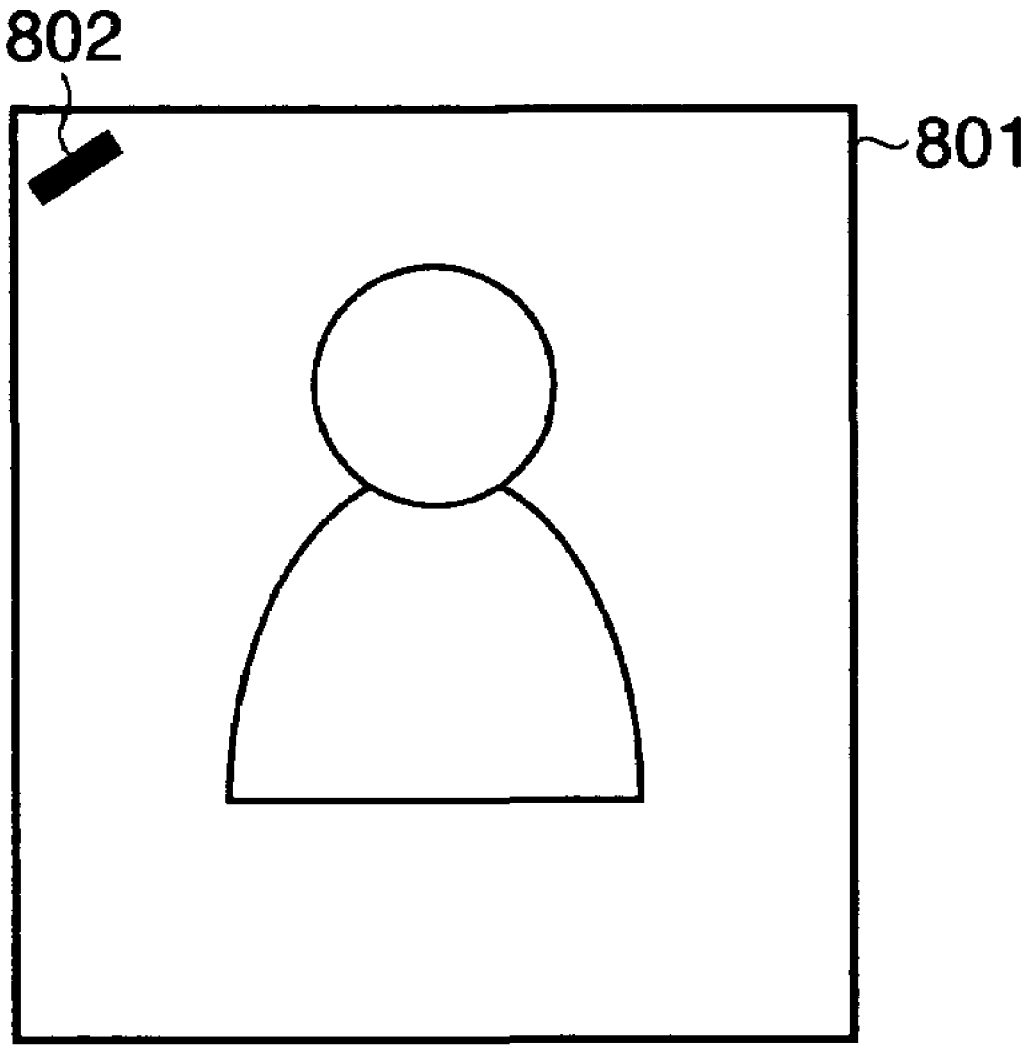
FIG. 8 is a view showing the state in which the staple having the radio identification tag adhered (i.e., a radio identification tag integrated with a staple) is attached to a printing medium.

FIG. 8 is a view showing the state in which a staple 802 having the radio identification tag 507 adhered (a radio identification tag integrated with a staple, 610 in FIG. 6) is attached to a printing medium 801. When the radio identification tag 507 capable of storing various image formation information in the nonvolatile memory 503 is adhered to the printing medium 801 as shown in FIG. 8, data concerning an image formed on the printing medium 801 can be related to data managed by a database. That is, on the basis of the information stored in the nonvolatile memory 503 of the radio identification tag 507, the image data can be related to the data in the database. This makes it possible to retrieve and reuse digital data of the original image desired by the user.

Figure 9:
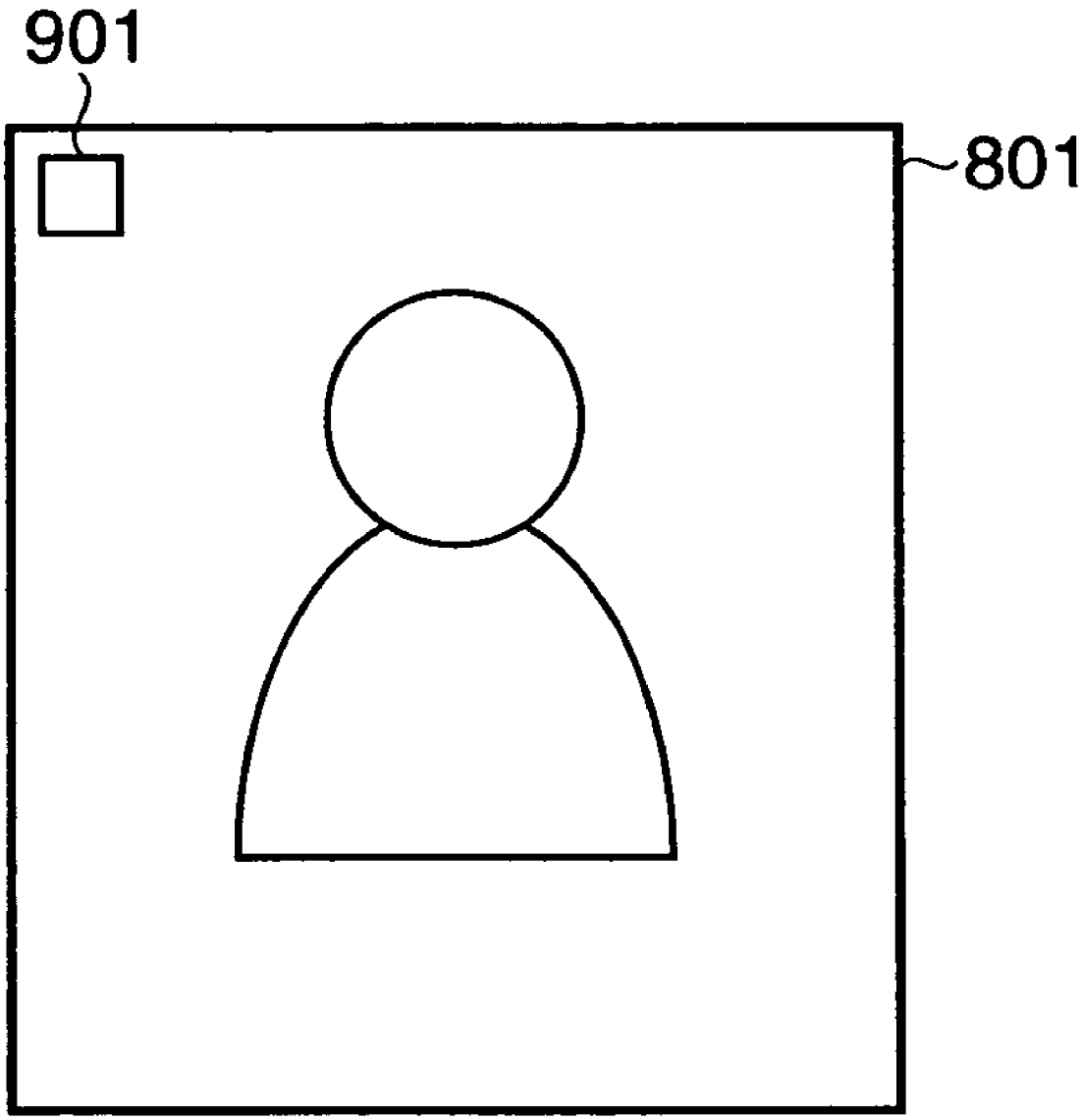
FIG. 9 is a view showing the state in which the radio identification tag deposited on a film is directly adhered to a printing medium.

The form of attachment of the radio identification tag 507 is not limited to the use of a staple. For example, as shown in FIG. 9, the radio identification tag 507 deposited on the film 610 may also be directly adhered on the printing medium 801. In this case, the radio identification tag 507 can be adhered to the printing medium 801 by a radio identification tag adhering device 272*b* (FIG. 11) in synchronism with image formation, or can be adhered to the printing medium before image formation is performed.

Figure 10:
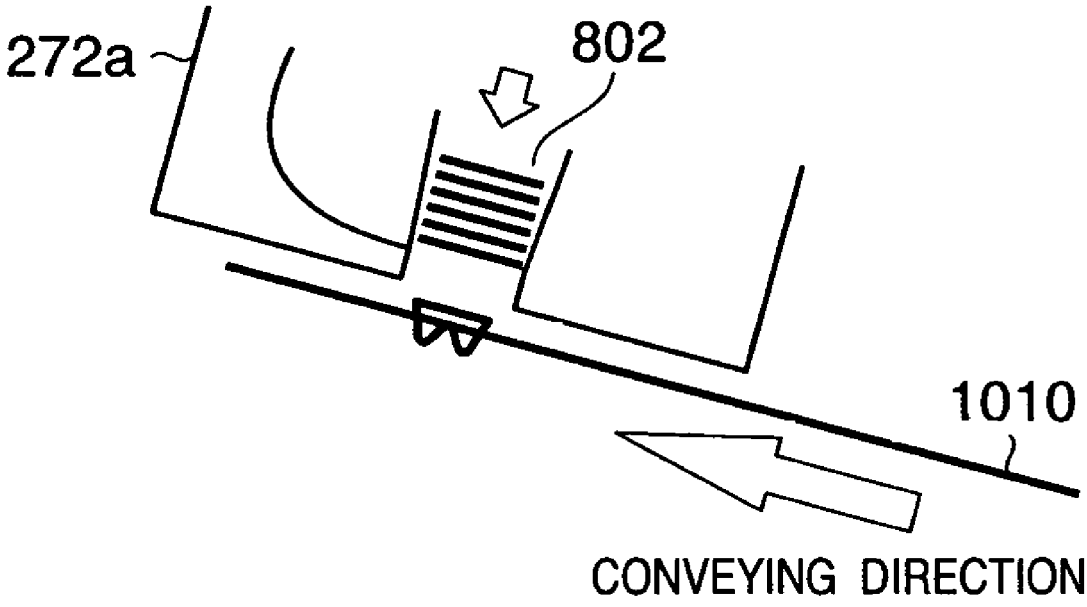
FIG. 10 is a view for explaining the operation of a radio identification tag adhering device for attaching the radio identification tag integrated with a staple to a printing medium.

FIG. 10 is a view for explaining the operation of a radio identification tag adhering device 272*a* which attaches a radio identification tag 802 integrated with a staple to a printing medium 1010. This attaching operation is performed after a toner image is thermally fixed on the printing medium 1010 by the fixing device 234 (FIG. 1). In the same manner as in a normal stapler operation, when the printing medium 1010 passes in the conveying direction indicated by an arrow below the radio identification tag adhering device 272*a*, the radio identification tag 802 integrated with a staple is attached to the printing medium 1010. In this operation, the tag can be attached to each of a plurality of printing media or to a single printing medium.

Figure 11:
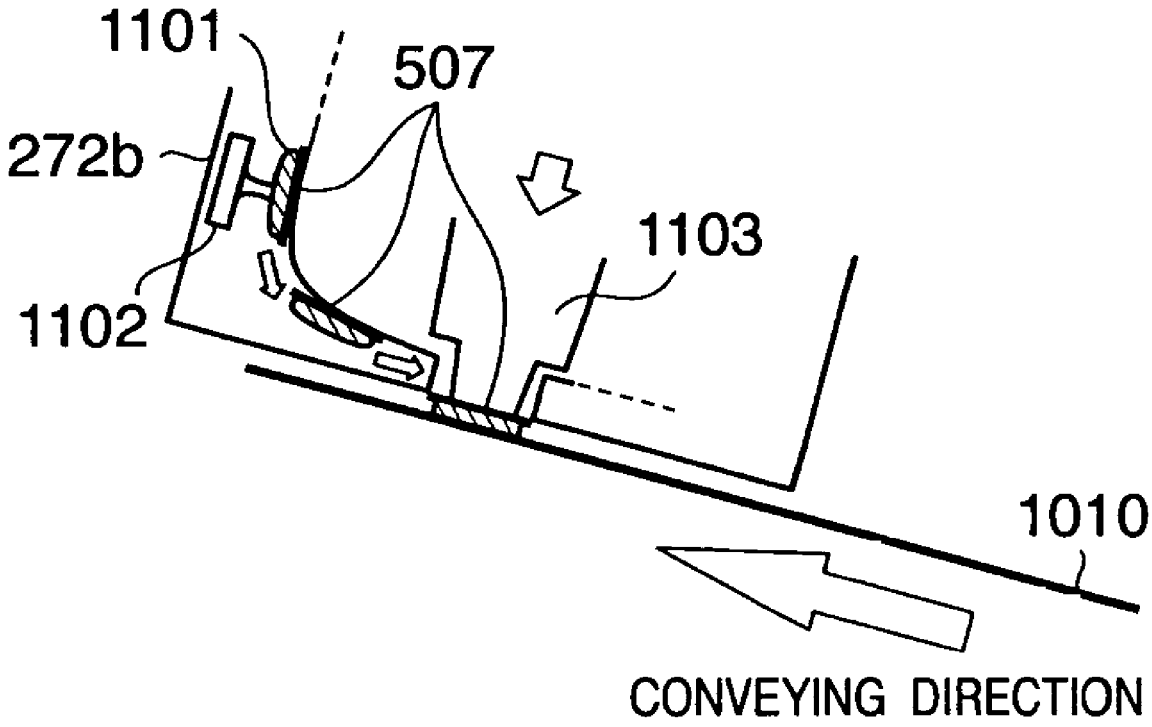
FIG. 11 is a view for explaining the operation of a radio identification tag adhering device for adhering the radio identification tag to a printing medium.

FIG. 11 is a view for explaining the operation of the radio identification tag adhering device 272*b* for adhering the radio identification tag 507 to the printing medium 1010 via, for example, the film 610 shown in FIG. 6. Similar to the operation shown in FIG. 10, the operation of the radio identification tag adhering device 272*b* is performed after a toner image on the printing medium 1010 is thermally fixed by the fixing device 234. A dispenser 1102 dispenses an adhesive 1101 onto the film on the radio identification tag surface. After that, when the printing medium 1010 passes in the conveying direction indicated by an arrow below the radio identification tag adhering device 272*b*, a pressing member 1103 presses that surface of the radio identification tag 507, which is coated with the adhesive against the printing medium 1010, thereby adhering the radio identification tag to the printing medium 1010.

When the radio identification tag 507 is to be adhered to the printing medium 1010 in advance, a heat shielding process (not shown) for protecting the radio identification tag is performed so that the radio identification tag is not destroyed by the pressure and heat when a toner image is thermally fixed after image formation.

<Information Write>

In synchronism with image formation, the radio identification tag information writing device 273 writes information (management information) for managing the image formed on a printing medium into the nonvolatile memory 503 of the radio identification tag 507 attached to the printing medium.

Figure 12A:
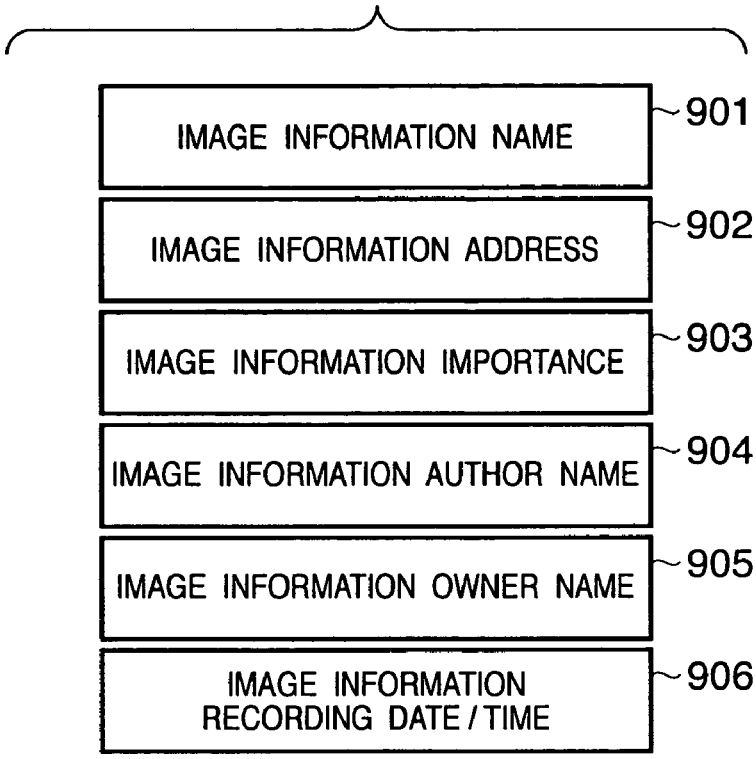
FIG. 12A is a view showing image formation management information to be stored in an nonvolatile memory 503 in the radio identification tag.

The radio identification tag information writing device 273 can store various information concerning image formation into the nonvolatile memory 503 in the radio identification tag 507 by communicating with the radio identification tag 507 by radio. As shown in FIG. 12A, for example, this information for managing an image contains an image information name 901, image information address 902, and the like. The image information name 901 relates to a name for uniquely specifying image data. By the image information name 901, the name with which image data printed on a printing medium is managed on a database can be specified.

The image information address 902 specifies, when original image data is digital data, a location where the latest digital data is stored at present. In the image forming apparatus of this embodiment, digital data can be collectively stored in the external large-capacity storage device 483 connected across a network to the image forming apparatus. All the digital data can be unitarily managed by URL addresses by the CPU 391 (FIG. 2) of the controller 200 (FIG. 1) of the image forming apparatus which realizes a web server function. In this case, the image information address 902 contains corresponding URL address information.

Image information importance 903 primarily serves as an index for limiting and/or inhibiting recopy and the like of a formed image. An image information author name 904 specifies the author of a formed image. An image information owner name 905 specifies a person who owns, uses, and outputs a printing medium itself on which an image is formed. Image information printing date/time 906 specifies the date and time at which an image is formed on a printing medium.

Note that the items of information to be managed in the large-capacity storage device 483 are not limited to those shown in FIG. 12A. That is, it is also possible to add, change, and update items to be managed in accordance with the contents of image formation.

Figure 12B:
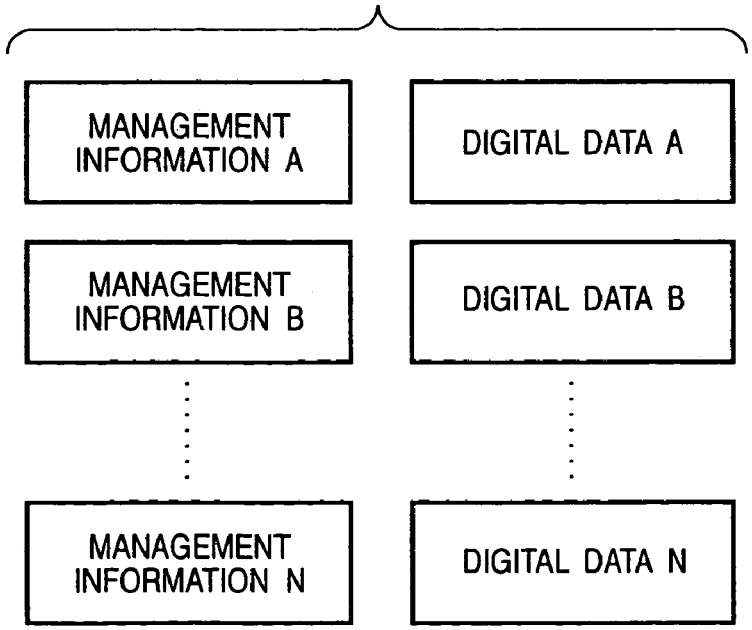
FIG. 12B is a view showing the relationship between management information and image information.

FIG. 12B is a view showing the relationship between the management information described above and digital data whose location is specified by the image information address 902 in the large-capacity storage device 483. When image information is digital data, digital data (A, B, . . . , N) are so stored as to be related to a plurality of pieces of information (A, B, . . . , N).

In accordance with instructions from an operator, the LAN interface device 482 sets management information concerning, for example, the image information 901 and image address 902 for managing image data. This management information is supplied to the external large-capacity storage device 483 and unitarily managed. Also, in accordance with instructions from an operator, the LAN interface device 482 can specify predetermined management information corresponding to image data to be processed by the image forming apparatus, from the management information stored in the external large-capacity storage device 483, and transmit this predetermined management information to an image forming apparatus 410 via a connector 404 and the external I/F 213 (FIG. 4).

The operator's instructions for specifying management information can be directly given to the LAN interface device 482. Alternatively, the instructions can be for example transmitted to the LAN interface device 482 via the external I/F 213 and connector 404 on the basis of an input from the operation unit 392 of the image forming apparatus, the specification of the image information name 901 or the like.

The CPU 391 (FIG. 2) of the image forming apparatus 410 transmits, to the radio identification tag writing device 273, the received management information as information to be written in the radio identification tag 507. The management information to be related to information which is unitarily managed in the external large-capacity storage device (483) is written, in synchronism with image formation, in the nonvolatile memory 503 of the radio identification tag 507 adhered to the printing medium, by the radio identification tag information writing device 273.

Figure 13:
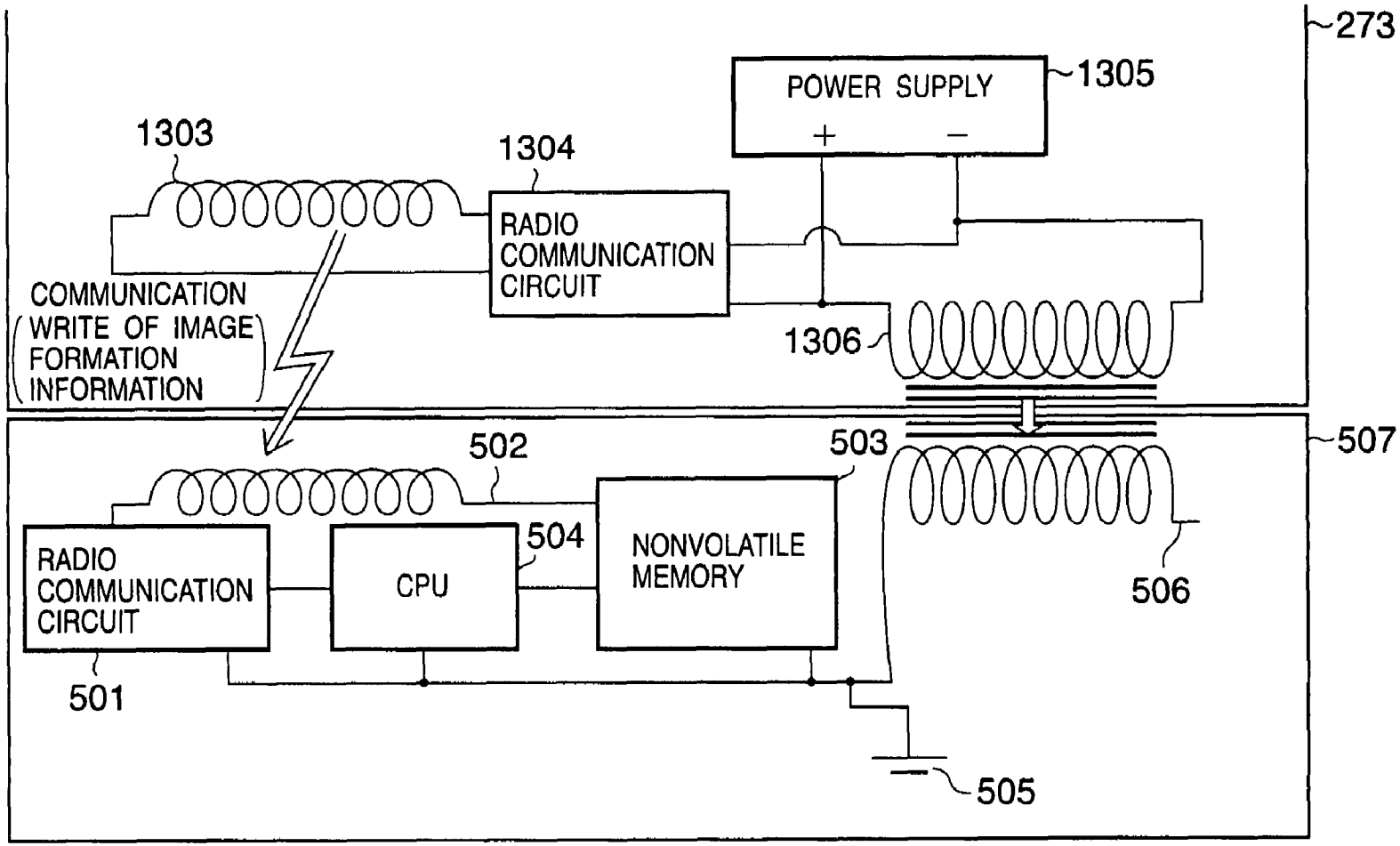
FIG. 13 is a view for explaining power supply from a radio identification tag information writing device to the radio identification tag.

FIG. 13 is a view showing the arrangement of the radio identification tag information writing device 273. The radio identification tag information writing device 273 has a radio communication circuit 1304, power supply 1305, electromagnetic induction circuit 1306, and antenna circuit 1303. Power supply to the radio identification tag 507 is performed in accordance with the principle of electromagnetic induction. As shown in FIG. 13, when the electromagnetic induction circuit 1306 of the radio identification tag information writing device 273 approaches the power generating circuit 506 in the radio identification tag 507, the electromotive force induced in the power generating circuit 506 is used to supply power to the radio identification tag 507. On the basis of this electromotive force, the radio communication circuit 501, nonvolatile memory 503, and CPU 504 can operate.

To form an image of digital image information on a printing medium, the information items (901 to 905) shown in FIG. 12A are recorded in the nonvolatile memory 503 in the radio identification tag 507. In the image forming apparatus according to this embodiment, when image formation is executed the information of the image information printing date/time 906 is recorded in the nonvolatile memory 503 in the radio identification tag 507 on the basis of date/time information managed by the CPU 391 of the image forming apparatus.

<Information Read>

Figure 14:
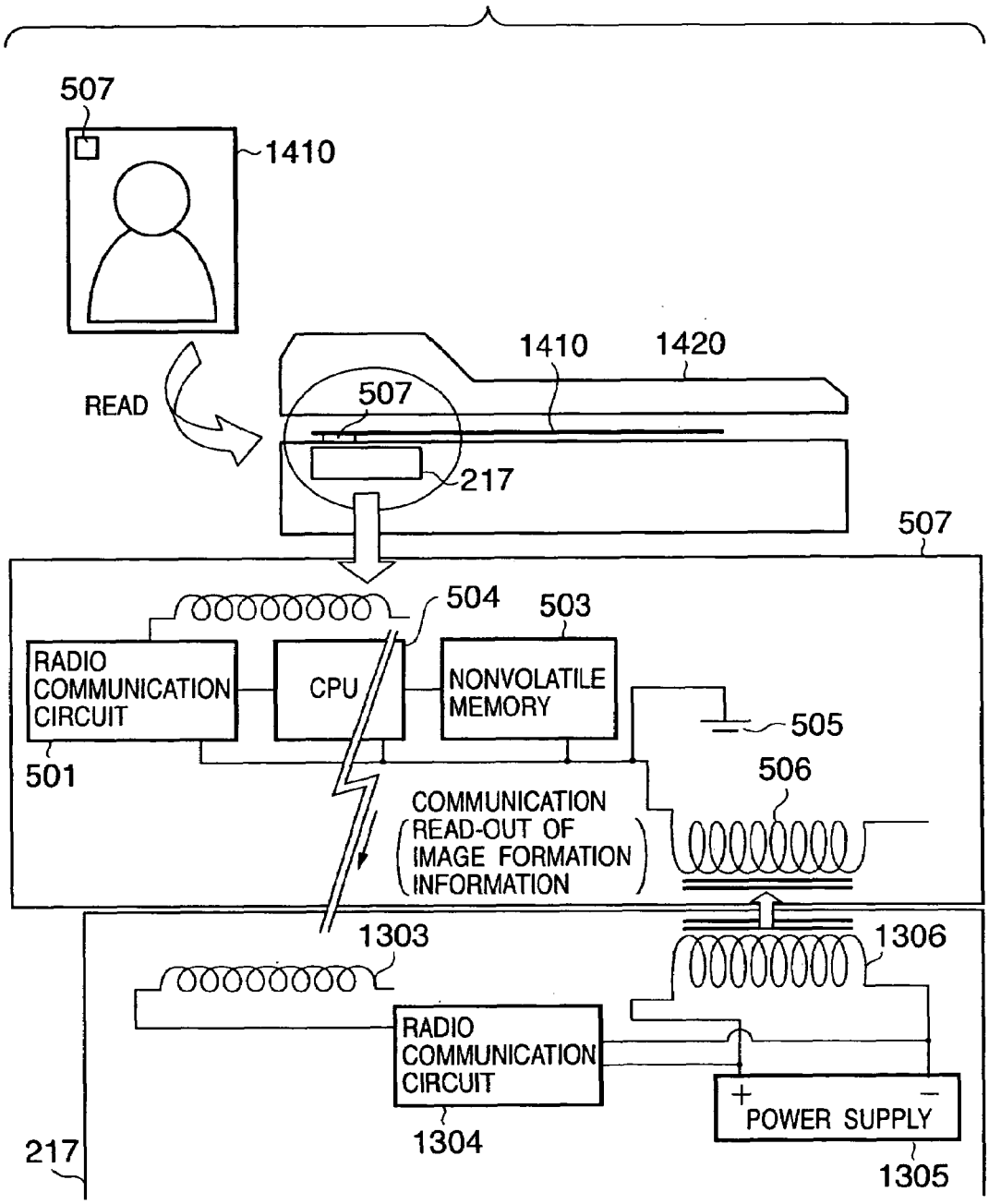
FIG. 14 is a view for explaining read of the image formation management information stored in the nonvolatile memory of the radio identification tag, and power supply to the radio identification tag.

Read of information written in the nonvolatile memory 503 of the radio identification tag 507 will be explained below. FIG. 14 is a view showing the arrangement of the radio identification tag information receiver 217 for reading out information from the radio identification tag 507 by radio communication. When a printing medium 1410 having the radio identification tag 507 adhered is read as an original by a color reader 1420, the radio identification tag information receiver 217 and the radio communication circuit 501 in the radio identification tag 507 adhered to the printing medium 1410 communicate with each other in synchronism with read of the original as shown in FIG. 14. Consequently, management information recorded in the nonvolatile memory 503 of the radio identification tag 507 is read by the radio identification tag information receiver 217.

During this management information read, power is supplied to the radio identification tag 507 by electromagnetic induction between the electromagnetic induction circuit 1306 of the radio identification tag information receiver 217 and the power generating circuit 506 of the radio identification tag 507. This power supply is the same as the above-mentioned power supply to the radio identification tag information writing device 273, so a detailed explanation thereof will be omitted.

By radio communication, the radio identification tag information receiver 217 acquires management information of the image information name 901, image information address 902 (this information can be acquired only when original image information is digital information and so the data is recorded, and cannot be acquired when original data is not digital data), image information importance 903, image information author name 904, and image information owner name 905. The controller 200 (FIG. 1) of the image forming apparatus 410 can communicate with the LAN interface device 482 and cause the LAN interface device 482 to transmit the latest management information in order to compare the management information acquired by the image forming apparatus with the management information unitarily managed in the external large-capacity storage device 483.

On the basis of this latest management information, the original image information can be retrieved. If the management information is updated, the controller 200 acquires the latest management information from the external large-capacity storage device 483, and updates the management information read by the radio identification tag information receiver 217. Also, the controller 200 compares the new management information formation date and time with the old ones to determine whether the image data is edited. If the image data is edited, the controller 200 acquires the latest image data, and prepares it as data for image formation. The image forming unit can execute an image formation process on the basis of the acquired latest image data.

The acquired latest management information is supplied to the radio identification tag writing device 273, and written, in synchronism with image formation, in the radio identification tag 507 attached to the formed printing medium.

When image formation is executed, the information pertaining to the image information printing date/time 906 is recorded in the nonvolatile memory 503 in the radio identification tag 507 on the basis of the date/time information managed by the CPU 391 for controlling printing of the image forming apparatus.

Depending on the importance of image information, no information need be recorded in the nonvolatile memory 503 in the radio identification tag in some cases. Unconditionally recording and managing information in all cases is sometimes inefficient from the viewpoint of system resources. In a case like this, an operator can select whether to record information on a printing medium by using the radio identification tag via the operation unit 392, and switch control of the image forming apparatus.

Figure 15A:
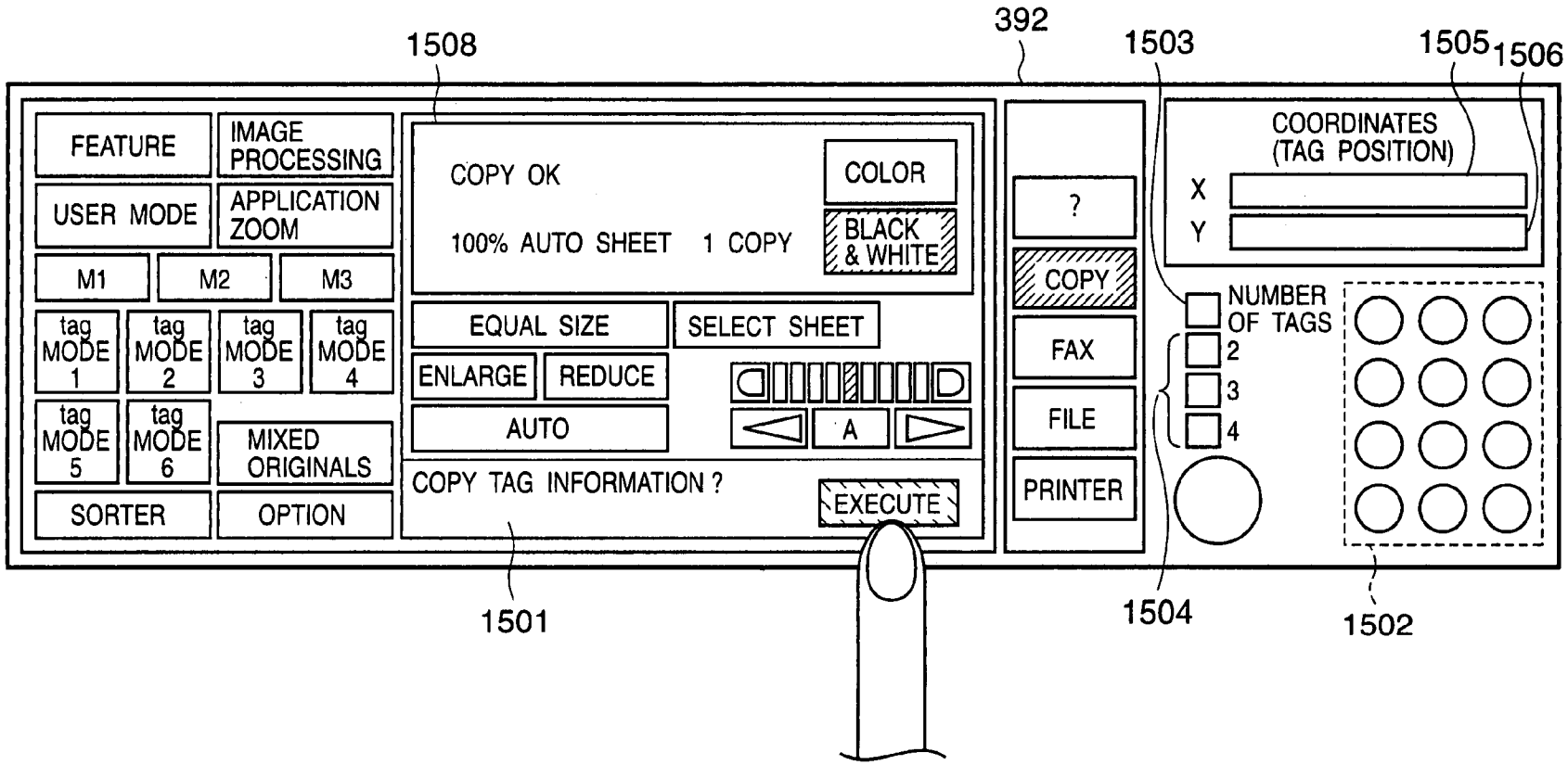
FIG. 15A is a view showing an input screen by which an operator selects whether to record radio identification tag information on a printing medium.

FIG. 15A is a view showing the contents displayed on an input screen for switching the control. When information is to be recorded by using the radio identification tag, the control of the image forming apparatus can be switched by selecting a button 1501 for executing recording of tag information. When the button 1501 is selected, a cassette or the like in which a printing medium having the radio identification tag adhered beforehand is stored is selected. Alternatively, in synchronism with image formation, the radio identification tag information receiver 217, radio identification tag adhering device 272, and radio identification tag information writing device 273 activate.

If the button 1501 is not selected, a normal image formation process which does not use any radio identification tag is executed.

In addition to the management information shown in FIG. 12A, data for inhibiting copying can also be stored in the radio identification tag 507. If this data for inhibiting copying is stored in the radio identification tag 507 of an original when data read by the color reader 1420 is to be copied by selecting the button 1501, the number of copies is limited, or copying itself is inhibited.

It is also possible to store, in the radio identification tag 507, information for limiting devices permitted to copy image information (for example, device identification information for specifying each device capable of copying), as management information by which security is taken into consideration.

The image information 901 and image address 902 for managing image information, the information for limiting copying of data, the information for security, and the like need not be set by the LAN interface device 482. For example, these pieces of information can also be set by an operation from the operation unit 392 on the basis of instructions from an operator. The set information is supplied to the radio identification tag writing device 273, and supplied to the external large-capacity storage device 483 via the external I/F 213 and unitarily managed, under the control of the CPU 391.

In this embodiment as described above, a radio identification tag is attached, in synchronism with image formation, to a printing sheet medium on which the image is formed, and management information for managing the image is stored in a nonvolatile memory of the radio identification tag. In this manner, the image formed on the printing sheet medium can be related to information unitarily managed in a database. This makes it possible to retrieve original image data, and reuse the retrieved image data.

Second Embodiment

Figure 16A:
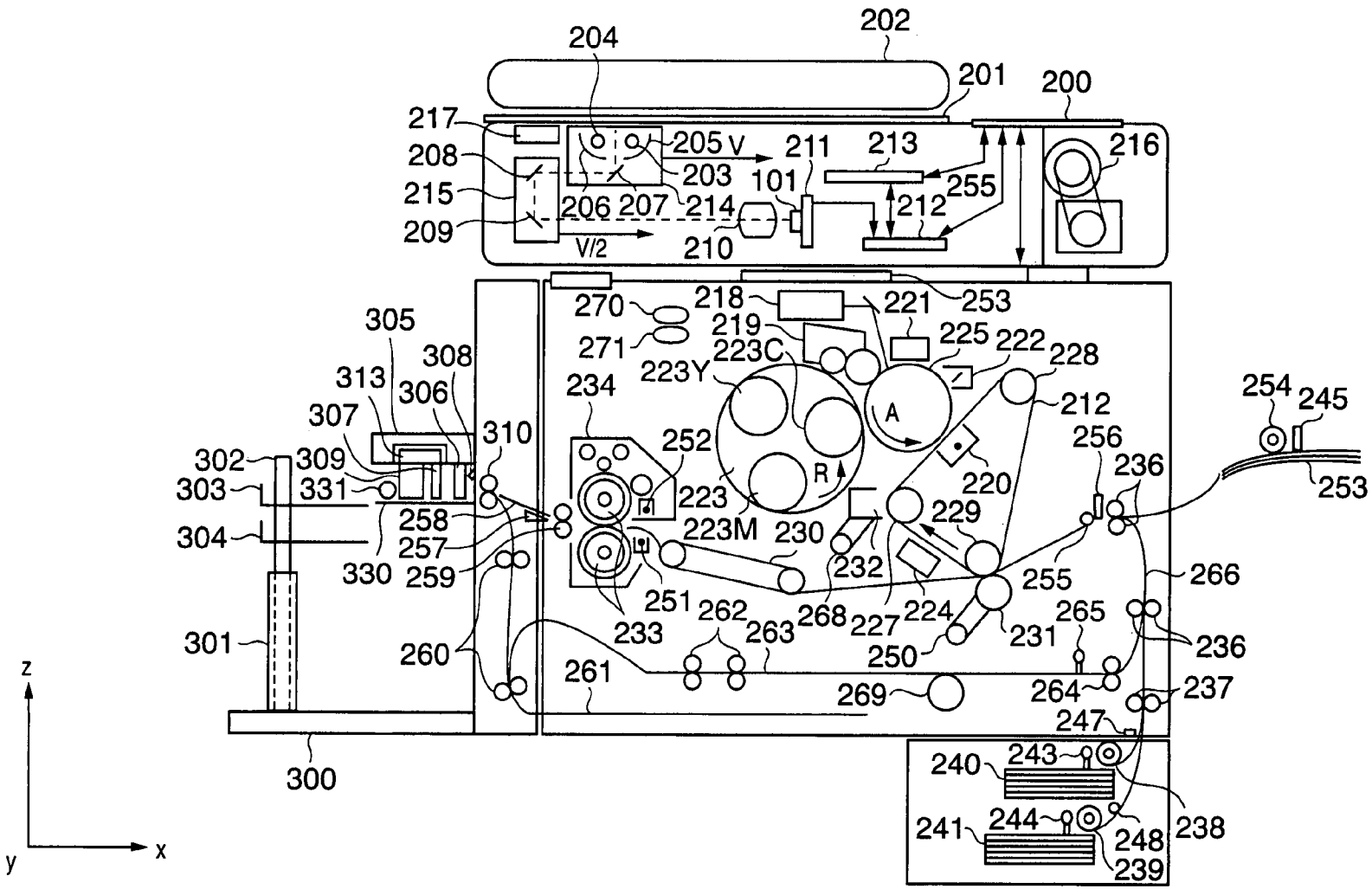
FIG. 16A is a view for explaining the arrangement of an image forming apparatus according to the second embodiment.

FIG. 16A is a view for explaining the arrangement of an image forming apparatus according to the second embodiment to which an image formation technique provided by the present invention is applied. The differences from the arrangement of the first embodiment shown in FIG. 1 are that the radio identification tag adhering device 272, radio identification tag information writing device 273, and paper discharge tray 242 are removed, and parts denoted by reference numerals 300 to 330 are added.

<Explanation of Discharge Mechanism>

Figure 16B:
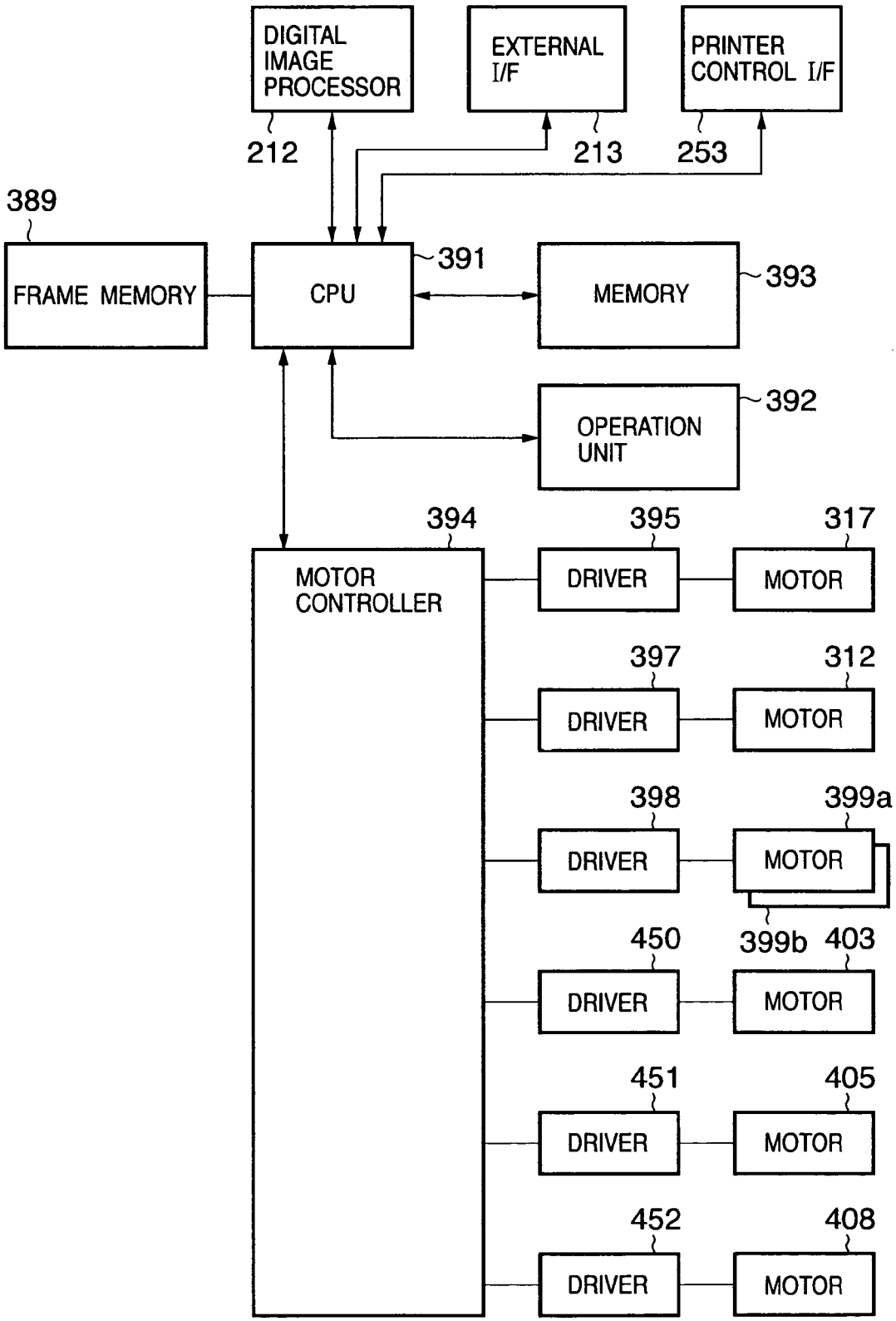
FIG. 16B is a block diagram showing the arrangement of a controller 200.

The newly added parts will be described below. Reference numerals 300 to 304 denote members forming a paper discharge tray unit of the image forming apparatus. A pole support base 300 fixes a support pole 301 standing upright on the floor surface. The support pole 301 thus fixed by the pole support base 300 has a hollow structure as indicated by the broken lines in FIG. 16A. This allows a movable pole 302 to vertically move in the support pole 301. For example, this vertical movement of the movable pole 302 is controlled by driving of a motor 317 under the control of a motor controller 394 and motor driver 395 shown in FIG. 16B.

Two paper discharge trays 303 and 304 are fixed to the movable pole 302. By controlling the vertical movement of the movable pole 302, a printing medium formed by the image forming apparatus can be sorted to one of the two paper discharge trays (303 and 304). For example, one paper discharge tray can be used when processing is normally performed (i.e., when an image is normally formed and information is also normally written in a radio identification tag), and the other paper discharge tray can be used when the image formation process is not normally performed or when the data write to a radio identification tag is not normally performed.

Figure 17:
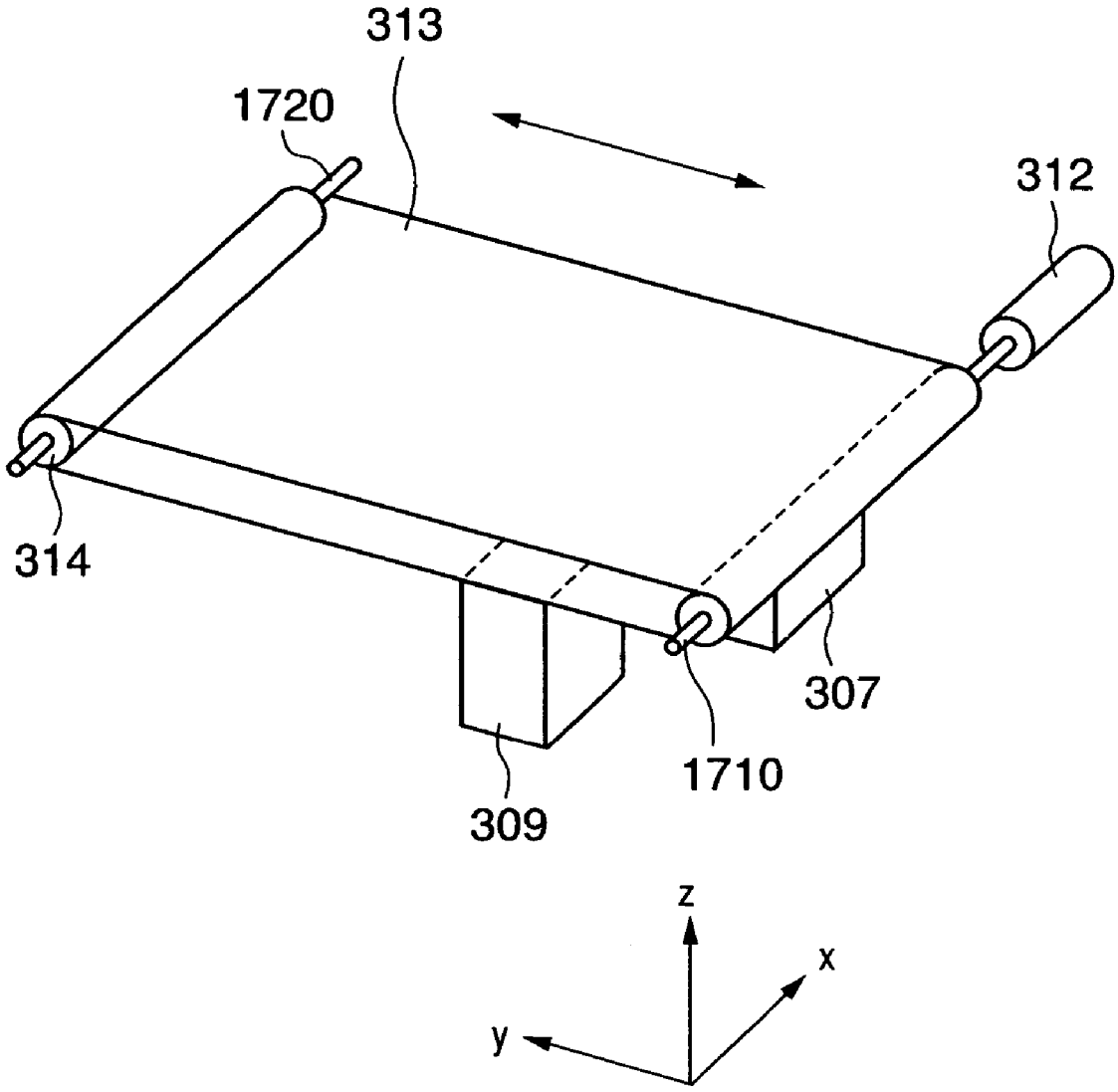
FIG. 17 is a view showing a practical arrangement of a movable belt 313.

A member 305 is supported by the main body of the image forming apparatus. The member 305 has a scanner unit 306 (or a sensor for checking an image formed by the image forming apparatus), and a movable belt 313. A practical arrangement of the movable belt 313 is as shown in FIG. 17. That is, the movable belt 313 is supported as it is given a predetermined tension by a rotational driving shaft 1710 of a motor 312 and a rotational driven shaft 1720. When the motor 312 is rotated, the movable belt 313 can be translated in the arrow direction (y-axis direction) shown in FIG. 17. The two ends of each of the rotational driving shaft 1710 and rotational driven shaft 1720 are supported by bearings (not shown), and rotatably attached to the member 305. The motor 312 is controlled by the motor controller 394 and a driver 397 shown in the block diagram of FIG. 16B.

A radio identification tag adhering device 307 and radio identification tag information reading/writing device 309 are attached to the movable belt 313, and can move in the y-axis direction shown in FIG. 17 in synchronism with the movable belt 313. This movement in the y-axis direction is performed to move and position the radio identification tag adhering device 307 and radio identification tag information reading/writing device 309 in accordance with the maximum width of a sheet to be discharged, so as to prevent, in accordance with the size of a printing medium used in the image forming apparatus, adhesion of a radio identification tag onto an image region formed on the printing medium. The radio identification tag adhering device 307 and radio identification tag information reading/writing device 309 can be positioned on the basis of a prescribed value matching the size of a printing medium as described above, and may also be positioned by controlling the motor 312 on the basis of position control information generated by the motor controller 394 on the basis of coordinate information supplied from an operation unit by a user.

Paper discharge rollers 310 and 311 have driving structures to which motors (for example, stepping motors) 399*a* and 399*b* (FIG. 16B) are added so as to stop conveyance of a printing medium at a necessary timing.

Figure 18:
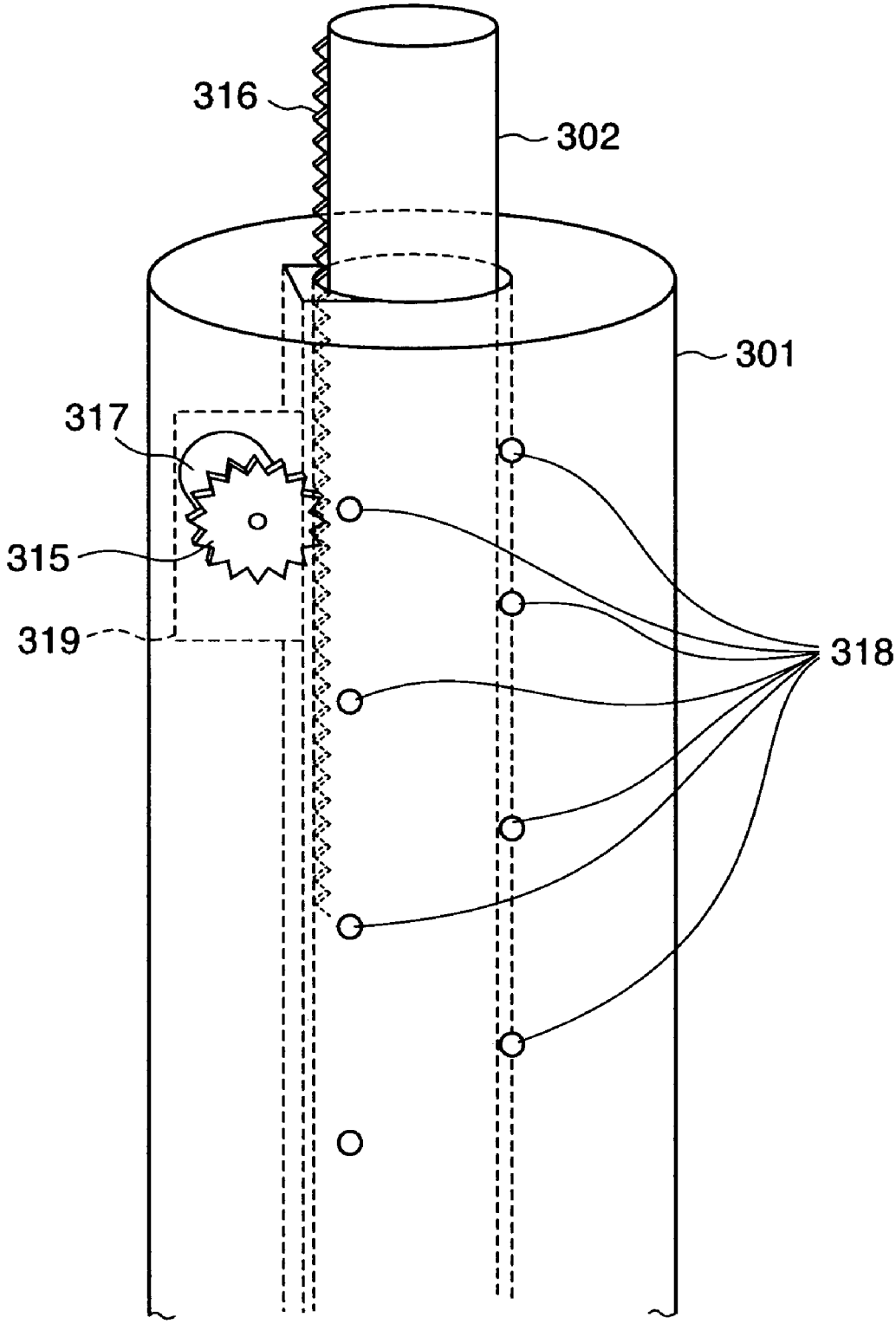
FIG. 18 is a view for explaining the structure of a support pole 301 and movable pole 302.

The structures of the support pole 301 and movable pole 302 will be explained below with reference to FIG. 18. The support pole 301 has a hollow structure in which the movable pole 302 is inserted and vertically movable by a driving mechanism. A linear rack gear 316 schematically illustrated in FIG. 18 is attached to the movable pole 302, and a motor 317 for giving a driving force of the vertical movement is attached to the support pole 301. A rotary gear 315 is attached to the driving shaft of the motor 317, and meshed with the rack gear 316 of the movable pole 302. The rotational driving force of the motor 317 rotates the rotary gear 315, and this rotary motion is converted into translation by the rack gear 316. This motion converted into the translating direction is the driving force which vertically moves the movable pole 302. A plurality of ball bearings 318 are arranged on the inner wall of the support pole 301 to allow smooth contact with the movable pole 302. The ball bearings 318 realize smooth motion while supporting the movable pole 302 by point contact.

The motor controller 394 (FIG. 16B) can move the movable pole 302 up or down to an arbitrary position (in the z direction) by controlling the rotating direction of the motor 317 by controlling the driver 395.

A paper discharge guide 308 supports paper discharge so as to guide a printing medium output from the paper discharge rollers 310 onto a paper discharge table 330, so that the scanner unit 306, radio identification tag adhering device 307, and radio identification tag information reading/writing device 309 can normally operate.

<Explanation of Operation>

Processing for a printing medium discharged from the image forming apparatus will be explained below with reference to a flowchart shown in FIG. 19A. The image forming operation of the image forming apparatus main body is substantially the same as that in the first embodiment, so a repetitive explanation thereof will be omitted, and only differences will be described. The image forming apparatus according to the first embodiment incorporates the radio identification tag adhering device 272 and radio identification tag information writing device 273. Therefore, a printing medium on which an image is formed by this image informing apparatus is discharged onto the paper discharge tray 242 (FIG. 1). In this embodiment, however, a printing medium on which an image is formed is guided by the paper discharge guide 308 so as to move on the paper discharge table 330 in accordance with the rotation of the paper discharge rollers 310 (S1901).

The paper discharge rollers 310 and 311 are connected to the motors 399*a* and 399*b* (FIG. 16B), respectively, and move in synchronism with each other so as to be able to stop conveyance of the printing medium in any arbitrary place. When the printing medium moves on the paper discharge table 330 in accordance with the rotation of the paper discharge rollers 310, the image on the printing medium conveyed onto the paper discharge table 330 is read by the scanner unit 306 (S1902), and supplied to a frame memory 389 of a CPU 391 of the image forming apparatus. The CPU 391 compares data of the image stored in the frame memory 389 with original image data (data stored in a memory 393) pertaining to image formation. The CPU 391 performs a neutralization process, if necessary, to obtain a correlation with the original image data, and compares the correlation value with a reference value for determining whether image formation is normally performed (S1903).

If the correlation value is equal to or larger than the reference value, the CPU 391 determines that a normal image formation process is performed, and advances the flow to step S1908. If the correlation value is less than the reference value in step S1903, the CPU 391 determines that the image formation process performed by the image forming apparatus is abnormal, and advances the flow to step S1904.

The scanner unit 306 used in step S1902 realizes the same function as the arrangement of the color reader 1420 (FIG. 14) explained in the first embodiment, so a detailed description thereof will be omitted. An arrangement for reading an image formed on a printing medium to determine whether the image is normally processed is not limited to the scanner unit. For example, it is also possible to use a light reflecting sensor which uses the reflection of projected light or a transmitting sensor which uses the transmission of light, thereby measuring the time during which a conveyed printing medium is sensed by projected light. If the sensing time is shorter than that for the original length (dimension) of a printing medium when image processing is normally performed, it is determined that the printing medium is wrinkled or copying is performed while the printing medium is obliquely moving. In this manner, the printing medium can be regarded as being abnormally processed.

Figure 19A:
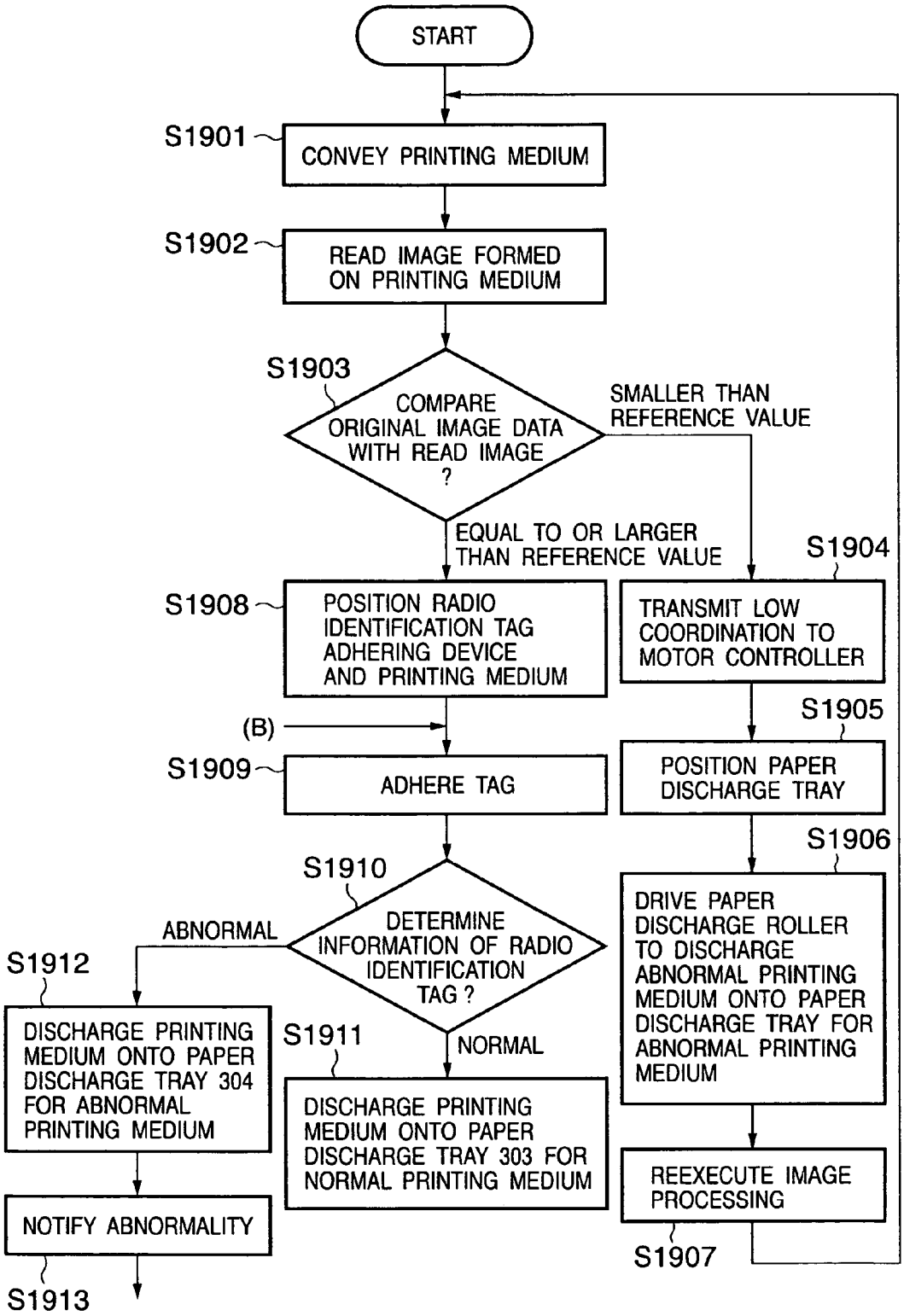
FIG. 19A is a flowchart for explaining the processing of a printing sheet discharged from the image forming apparatus.
Figure 19B:
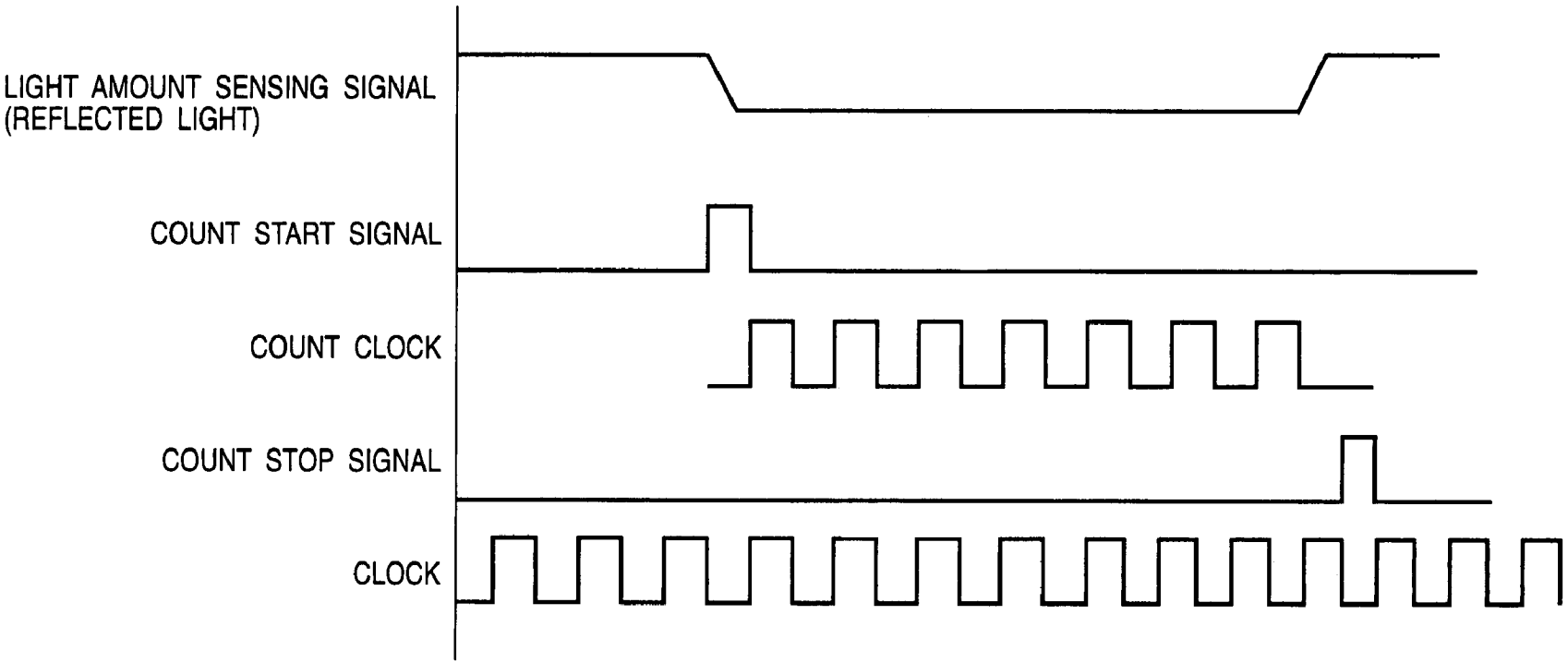

FIG. 19B is a timing chart showing the relationships between a light amount sensing signal (reflected light), count clock signal, and the like. The passing time may also be measured by a sensor as follows. That is, a light amount change caused when a printing medium passes by the sensor is sensed by the sensor, and a counter is activated by using this light amount change as a trigger (count start signal). This counter is stopped by using a light amount change caused when the printing medium leaves the sensor measurement region, as a counter stop trigger signal (stop signal). The obtained count of the counter is compared with a premeasured reference value pertaining to the length (dimension) of the printing medium when image processing is normally performed. In this way, whether image processing is normally performed can be determined.

By this determination, if, for example, a printing medium is obliquely conveyed, the sensor measurement time is shorter than that when the printing medium is normally conveyed. Therefore, it is possible to sense that image formation performed on the conveyed printing medium is abnormal.

If the correlation with the original image data is found to be low in step S1903, the CPU 391 determines that the image of this printing medium is abnormal, and advances the flow to step S1904.

The CPU 391 transmits a signal indicating the low correlation (indicating the abnormality) to the motor controller 394 (S1904). Upon receiving this signal, the motor controller 394 drives the motor 317 for driving the movable pole 302 to move it to a height at which the printing medium on the paper discharge table 330 can be discharged, thereby positioning the paper discharge tray 304 for abnormal images (S1905). When the motor 317 is a pulse motor, for example, rotational driving of the motor 317 can be controlled in proportion to a necessary number of pulses by applying these pulses from the motor driver 395 to the motor 317.

After the paper discharge tray 304 is vertically moved and positioned, the paper discharge roller 311 rotates to discharge the printing medium on the paper discharge table 330 onto the paper discharge tray 304 for abnormal images (S1906). For a printing medium found to be abnormal, the radio identification tag adhering device 307 and radio identification tag information reading/writing device 309 do not operate, so no radio identification tag is attached and no management information is written.

The flow then advances to step S1907. If the printing medium is found to be abnormal in step S1903, the CPU 391 controls the image forming apparatus to execute image formation on the basis of the original image data, in order to form the same image again (S1907). Details of this image formation process are explained in the first embodiment, so a repetitive description thereof will be omitted. The printing medium on which an image is formed in step S1907 is conveyed to the paper discharge table 330, and undergoes the processing on and after step S1901 described above.

If the printing medium is found to be normal in step S1903, the flow advances to step S1908. In step S1908, the radio identification tag adhering device 307 is positioned to prepare for adhesion of a radio identification tag to the printing medium. This positioning can be performed on the basis of a prescribed value corresponding to the type of printing medium. The positioning can also be performed on the basis of a user designated value so that a radio identification tag can be adhered to that region of a printing medium, which is designated from an operation unit 392 by the user in advance.

The CPU 391 transmits, to the motor controller 394, information concerning the dimension of the printing medium or information concerning the user's designation. On the basis of this information, the motor controller 394 controls the motor 399*a* for driving the paper discharge rollers 310 in order to position the printing medium in a predetermined position in the conveying direction (x direction) on the paper discharge table 330. In addition, the motor controller 394 controls the motor 312 for driving the movable belt 313 in synchronism with the positioning in the conveying direction, thereby positioning the radio identification tag adhering device 307 in the widthwise direction (y direction) of the printing medium. The motor driver 394 can be controlled by a user designated value as follows. That is, when the motor is a stepping motor, for example, the number of transmitted pulses is proportional to the number of rotations of the motor. Therefore, accurate control to a given position can be performed by obtaining the relationship between the number of pulses and the position beforehand.

A practical example of the operation of designating a position where a radio identification tag is to be adhered will be described below with reference to FIG. 15A which shows a practical arrangement of the operation unit 392. First, the user presses a number-of-tag key 1503 of the operation unit 392, and enters the number of radio identification tags by using numerical keys 1502 (if the number of tags is not entered, 1 is set as a default value). Then, the user sets an X-coordinate 1505 by using the numerical keys 1502, and presses one of number-of-tag keys 1504 to determine the X-coordinate value of the corresponding number. Likewise, the user sets a Y-coordinate 1506 by using the numerical keys 1502, and presses one of the number-of-tag keys 1504 to determine the Y-coordinate value of the corresponding number. When the user inputs these operations equal in number to the radio identification tags, the CPU 391 can detect the number of radio identification tags to be adhered, and the coordinate values for specifying the adhesion position of each tag.

Figure 15B:
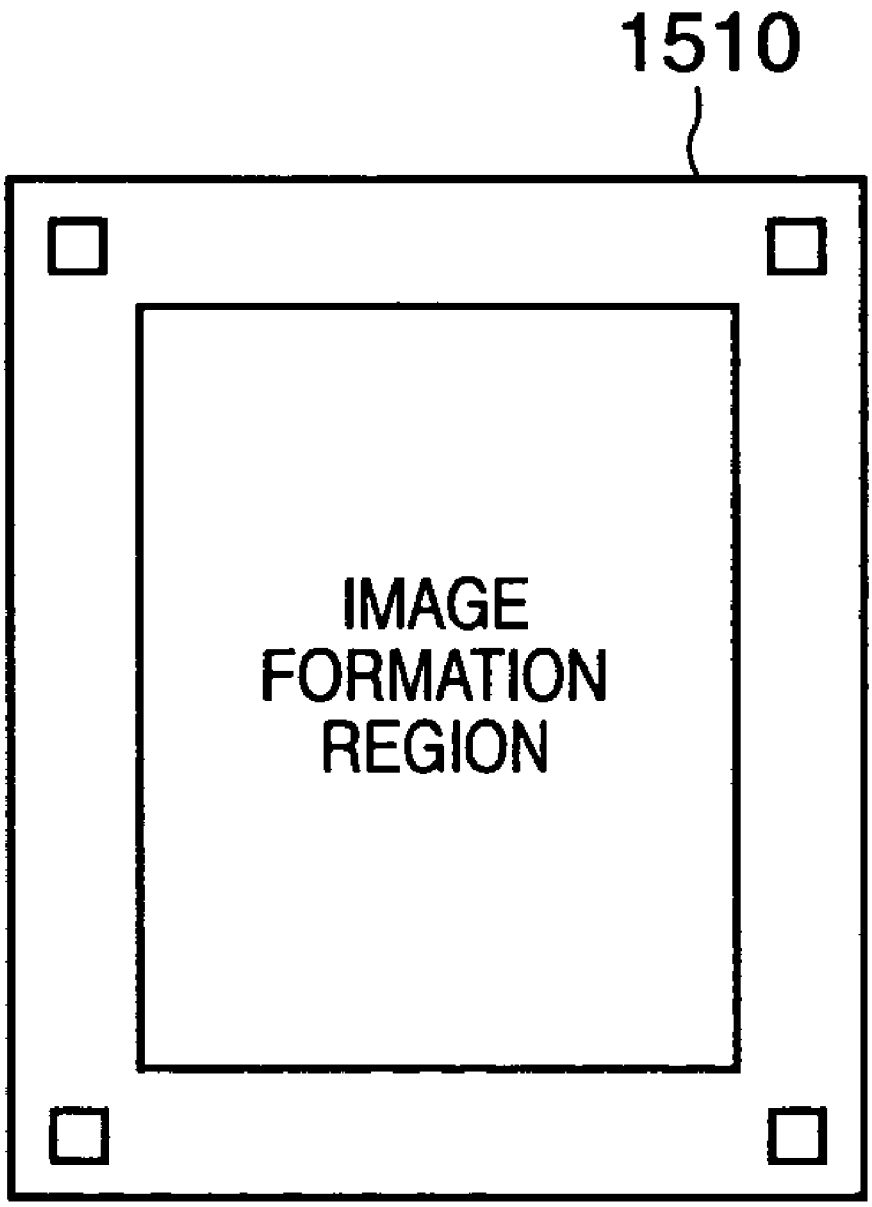
FIG. 15B is a view for explaining positions where the radio identification tags are adhered by using prescribed values.

When positioning is performed by a prescribed value, one of the four corners can be designated in accordance with the dimensions of a printing medium 1510 (FIG. 15B). It is also possible, if necessary, to designate all the four corners of a printing medium. In this case, the CPU 391 transmits input instructions from the operation unit 392 to the motor controller 394, and the motor controller 394 controls the motors 312 and 399*a*. In this manner, the printing medium and the radio identification tag adhering device 307 can be aligned in the designated positions.

If the user inputs instructions to staple the printing medium from the operation unit 392, the CPU 391 can automatically limit the operation of the radio identification tag adhering device 307 so as not to adhere a radio identification tag to the position of stapling, thereby preventing overlapping of the stapling position and radio identification tag adhesion position. Also, the CPU 391 determines a region (non-image region) where no image is formed on the printing medium on the basis of the image read by the scanner unit 306 (S1902), and, on the basis of this determination result, transmits information pertaining to this non-image region to the motor controller 394. On the basis of this non-image region information, the motor controller 394 can control positioning of the printing medium and the radio identification tag adhering device 307 such that a radio identification tag is adhered to this non-image region. If the coordinate values designated by the user fall outside the non-image region, the motor controller 394 can control positioning so that a radio identification tag is adhered in the non-image region, by correcting the values designated by the user. The foregoing is the positioning process in step S1908 of FIG. 19A.

In step S1909, the radio identification tag adhering device 307 adheres a radio identification tag to a predetermined position.

In step S1910, the CPU 391 determines whether the information of the radio identification tag is normal by using the radio identification tag information reading/writing device 309. Data read and write by the radio identification tag information reading/writing device 309 are the same as the functions of the radio identification tag information receiver 217 and radio identification tag information writing device 273 described in the first embodiment, so a detailed explanation thereof will be omitted. If the adhered radio identification tag is an unrewritable radio identification tag which is prewritten in the factory, the radio identification tag information reading/writing device 309 reads out the management information written beforehand in the radio identification tag adhered on the printing medium, without performing any writing operation, and determines whether the radio identification tag is normal. Whether the information written in the radio identification tag is normal is determined by comparing the contents of the prewritten management information with the contents of the readout management information. The contents of the prewritten management information can be stored in an external large-capacity storage device 483. A controller 200 of the image forming apparatus can download this information by communication when determining whether the information written in the radio identification tag is normal.

If the contents of the readout management information match the contents of the prewritten management information, the CPU 391 determines that the radio identification tag is normal, and advances the flow to step S1911 to control the height of the paper discharge tray 303 for normal printing media. After the paper discharge tray 303 is vertically moved and positioned, the paper discharge roller 311 rotates to discharge the normal printing medium on the paper discharge table 330 onto the paper discharge tray 303 for normal images (S1911).

If the radio identification tag is found to be abnormal in step S1910, the flow advances to step S1912. After the paper discharge tray 304 is vertically moved and positioned, the paper discharge roller 311 rotates to discharge the printing medium on the paper discharge table 330 onto the paper discharge tray 304 for abnormal images (S1912). In this case, the CPU 391 can display, on a display unit 1508, a message indicating that the printing medium having the radio identification tag in which abnormal information is written is output. The CPU 391 can also communicate with an information processor 484 connected to the network via an external I/F 213, and notify the operator of the occurrence of abnormality by display control (S1913).

To sense defects of radio identification tags in early stages, allow easy collection of radio identification tags, and prevent waste of printing media, the process in step S1910 in which whether the information of the radio identification tag is normal is determined can also be shifted, after the positioning process in step S1908, to (B) shown in FIG. 19A which is a preprocess of adhesion to the printing medium. In this process shift, an operation mode related to the radio identification tag can be selectively set by using tag mode keys 1 to 6 of the operation unit 392 shown in FIG. 15A. In this case, the radio identification tag information reading/writing device 309 reads out management information stored in a nonvolatile memory of only a radio identification tag (414 in FIG. 20A) which is supplied to an attachment position by rotating a radio identification tag roll 401 (FIG. 20A) by the radio identification tag adhering device 307 (tags in the radio identification tag adhering device 307 are shielded, so data cannot be read or written by the radio identification tag information reading/writing device 309). On the basis of this readout information, the CPU 391 determines whether normal management information such as an image information name is stored, and whether the data's parity is normal, thereby determining whether the radio identification tag is normal.

In this determination in step S1910, as a reference value for determining whether the management information as the readout information of the radio identification tag is normal, the contents of the prewritten management information which is data stored in the external large-capacity storage device 483 can be downloaded across the network. Alternatively, it is possible to input data from the operation unit 392 of the image forming unit main body, and compare the input data as a reference value with the readout management information.

The processing from steps S1909 to S1911 can be similarly performed for a writable radio identification tag. In this case, the radio identification tag information reading/writing device 309 writes predetermined management information in a radio identification tag adhered on a printing medium (step S1909), and reads out the written management information at the next timing, and the CPU 391 determines whether the pieces of information written and read out by the radio identification tag information reading/writing device 309 match (step S1910). If the two pieces of information match, the CPU 391 determines that this radio identification tag is normal, and advances the flow to step S1911. If the information written in step S1910 and readout information do not match, the CPU 391 determines that the radio identification tag is abnormal, and advances the flow to step S1912. The tag information determination process may also be shifted, by user's designation, to the timing ((B) in FIG. 19A) before the tag is adhered to the printing medium. In this case, it is possible to previously write and read out the management information and determine whether the two pieces of information match, thereby determining whether the rewritable radio identification tag normally functions.

<Retry Process>

Figure 19C:
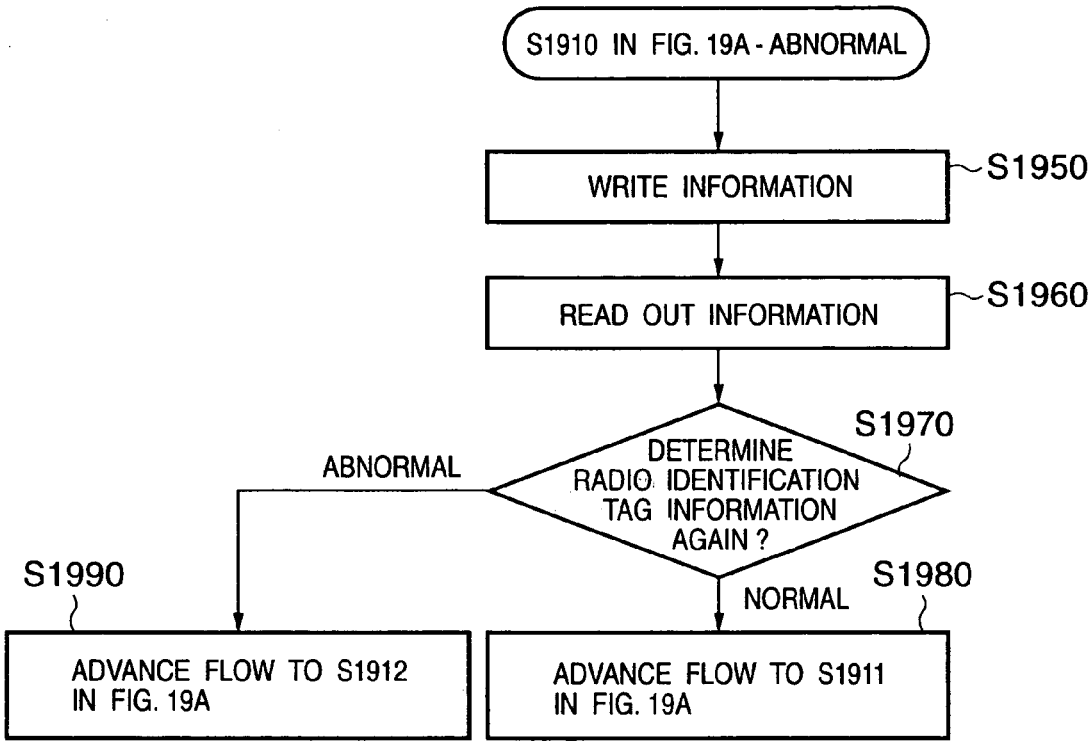
FIG. 19C is a flowchart for explaining the flow of a retry process.

If abnormality is found in step S1910, a retry process can be executed (a flowchart in FIG. 19C). In this retry process, an operation mode related to the radio identification tag can be selectively set in accordance with user's designation by using the tag mode keys 1 to 6 shown in FIG. 15A. If the radio identification tag is found to be abnormal in step S1910 of FIG. 19A, predetermined management information is written in the radio identification tag again (S1950), the written management information is read out (S1960), and determination is performed again (S1970).

If the pieces of information written and read out by the radio identification tag information reading/writing device 309 match, the CPU 391 determines that the radio identification tag is normal, and advances the flow to step S1911 in FIG. 19A(S1980). If the radio identification tag is found to be abnormal in step S1970, the flow advances to step S1912 in FIG. 19A(S1990). Also, the number of times of repetition of the retry process can be designated by the user by using the tag mode keys 1 to 6 shown in FIG. 15A.

<Arrangement of Radio Identification Tag Adhering Device 307>

Figure 20A:
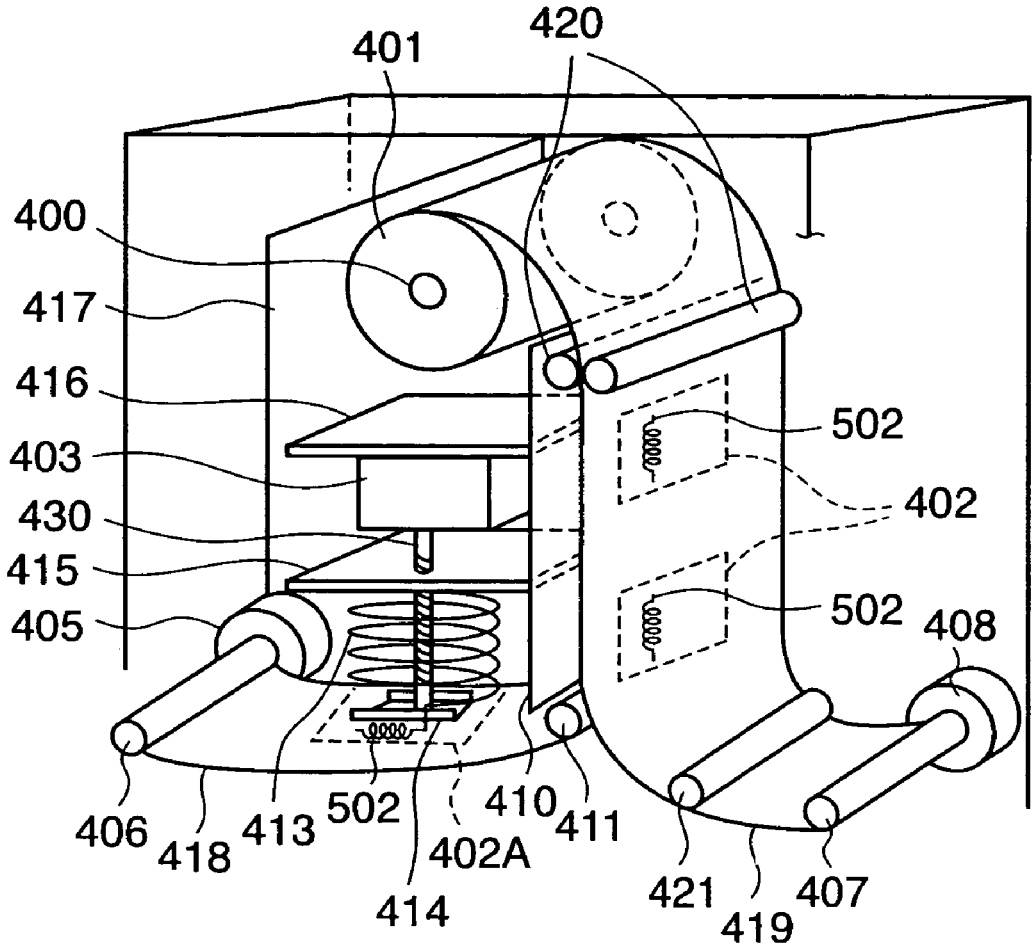
FIG. 20A is a view showing details of the structure of a radio identification tag adhering device 307.
Figure 20B:
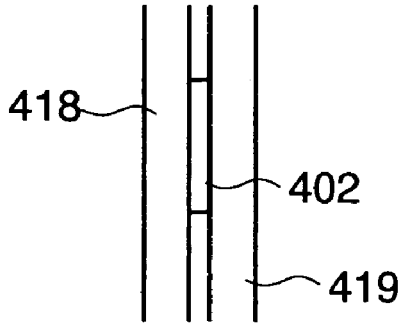
FIG. 20B is a view showing a three-layered structure made up of a pasteboard 418, radio identification tag 402, and tag cover paper 419.

FIG. 20A shows details of the structure of the radio identification tag adhering device 307. In FIG. 20A, reference numeral 400 denotes a bearing which rotatably supports the radio identification tag roll 401. As shown in FIG. 20B, the radio identification tag roll 401 has a three-layered structure of a pasteboard 418, radio identification tag 402, and tag cover paper 419. The radio identification tags 402 are mounted at predetermined spacings on the pasteboard 418.

Reference numeral 407 denotes a take-up unit for the tag cover paper 419. When a stepping motor 408 is driven, the take-up unit 407 rotates to control take-up of the tag cover paper 419. A take-up unit 406 for the pasteboard 418 controls take-up driving of the pasteboard 418 by rotational driving of a stepping motor 405. Reference numeral 411 denotes a separation roller for separating the tag cover paper 419 and pasteboard 418. The separation roller 411 is rotatably supported so as to feed the pasteboard 418 to the take-up unit 406 in contact with the pasteboard 418. Shield plates 410 and 417 are used to disable access for data read and write from the radio identification tag information reading/writing device 307 to radio identification tags except for a radio identification tag (402A) immediately below a press plate 414. A metal plate 416 for supporting a stepping motor 403 is fixed to the frame side surfaces on the front and back sides of the radio identification tag adhering device 307.

A male screw is formed at the tip of a motor rotating shaft 430 of the stepping motor 403. Reference numeral 415 denotes a press plate having a female screw which meshes with the male screw of the rotating shaft 430 of the stepping motor 403. The press plate 415 can vertically move smoothly between the shield plates 410 and 417 in accordance with the rotation of the stepping motor 403 fixed to the metal plate 416. One end of a spring 413 is fixed to the metal plate 416, and the other end of the spring 413 is fixed to the press plate 414. Reference numeral 420 denotes roll sheet extracting rollers for extracting the radio identification tag roll 401 into the form of a sheet. The separation roller 411 and a separation roller 421 separate the roll sheet having the three-layered structure into the pasteboard 418 and tag cover paper 419.

The operation of the radio identification tag adhering apparatus 307 will be described below.

Before the radio identification tag roll 401 is set in the device 307, the end of the tag cover paper 419 is inserted into the take-up unit 407 for the tag cover paper 419, and the end of the pasteboard 418 is inserted into the take-up unit 406 for the pasteboard 418. After the ends of the pasteboard 418 and tag cover paper 419 are thus set in the take-up units 406 and 407, the stepping motors 405 and 408 of these take-up units rotate in synchronism with the attaching timing of the radio identification tag 402, thereby taking up the pasteboard 418 and tag cover paper 419.

The lower surface of the radio identification tag 402 is coated with a strong, quick-drying adhesive material (adhesive), so this radio identification tag is adhered on the pasteboard 418. The radio identification tag 402 is so controlled as to stop immediately below the press plate 414 in accordance with the feeding operation of the pasteboard 418. If necessary, a sensor (not shown) for sensing the arrival of the radio identification tag 402 at this position may also be used. For example, when a sensor which senses the projection and reception of light is used, the light amount on the light receiving side of the sensor changes if the radio identification tag 402 adhered on the pasteboard 418 intercepts the sensor light. On the basis of this change in light amount, the presence/absence of the radio identification tag 402 can be sensed. The sensing information of the sensor can also be fed back to urgently stop the driving of the stepping motors 405 and 408 of the take-up units.

While the radio identification tag 402A is standing still immediately before the press plate 414, the radio identification tag 402A is not affected by the shield plates 410 and 417, so data write and read by radio are possible. Also, as shown in FIG. 5, an antenna circuit 502 of the radio identification tag 402 has a directional pattern. Therefore, the radio identification tag 402 before the tag cover paper 419 and pasteboard 418 are separated and the radio identification tag 402A positioned immediately below the press plate 414 are held such that the directional patterns of the antenna circuits 502 point in different directions. Accordingly, the radio identification tag information reading/writing device 309 can access only the radio identification tag 402A positioned immediately below the press plate 414, in respect of the absence of the influence of the shield plates 410 and 417 and the directional pattern of the antenna circuit.

On the basis of the position information for attaching the radio identification tag to the printing medium, the CPU 391 controls the stepping motor 399*a* for controlling the paper discharge roller 310 and the motor 312 for driving the movable belt 313, thereby moving and positioning the radio identification tag adhering device 307 in a position where the radio identification tag is attached. When the positioning of the radio identification tag adhering device 307 is completed, the stepping motors 310 and 312 stop, and the stepping motor 403 starts rotating to mesh the male screw of the rotating shaft 430 with the female screw of the press plate 415, thereby moving the press plate 415 downward. The spring 413 is compressed by this downward motion of the press plate 415. The restoration force of the spring 413 thus compressed is the driving force for pushing down the press plate 414. The press plate 414 moves down to press, from the upper surface of the pasteboard 418, the radio identification tag 402A against the surface of the printing medium 330.

That lower surface of the radio identification tag 402A, which is brought into contact with the printing medium 330 is coated with a quick-drying, strong adhesive material. Therefore, once the radio identification tag is pushed against the surface of the printing medium 330 from the upper surface of the pasteboard 418 as described above, this radio identification tag is adhered to the printing medium. When the radio identification tag is thus attached on the printing medium, the motor controller 394 rotates the stepping motor 403 in the opposite direction to move the press plate 415 upward, thereby releasing the spring 413 from the compression. Since this cancels the driving force for moving down the press plate 414, the press plate 414 moves up. By repeating these series of operations, the radio identification tag attached on the pasteboard 418 can be adhered to the predetermined position of the printing medium 330.

An example of the operation mode is as follows. That is, if abnormality is found in step S1910 of FIG. 19A, the stepping motor 405 is rotated fast to take up the defective ratio identification tag attached to the pasteboard 418 to the take-up unit 406, and the next normal radio identification tag 402 is adhered to the printing medium.

It is also possible to control the take-up operation of the pasteboard 418 such that if abnormality is found after the user repeats the abnormality check by an arbitrary number of times, for example, twice or more by using the tag mode keys 1 to 6 shown in FIG. 15A, the defective radio identification tag is skipped, and a normal radio identification tag is adhered to the printing medium.

Third Embodiment

Figure 21:
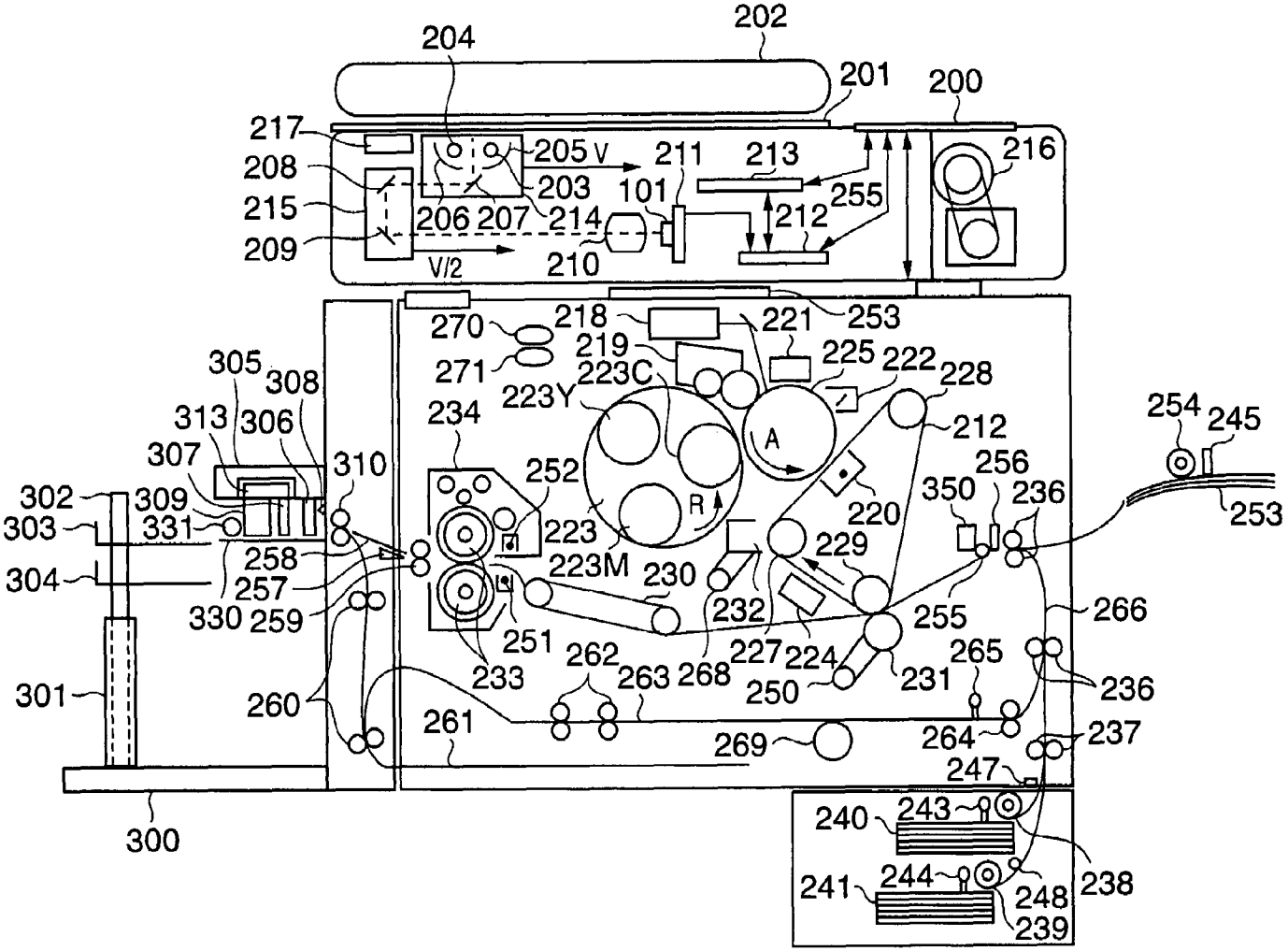
FIG. 21 is a view showing the arrangement of an image forming apparatus according to the third embodiment.

The contents of the third embodiment will be described below with reference to FIGS. 21 and 22. The arrangement shown in FIG. 21 differs from FIG. 16A of the second embodiment in that a unit 350 (to be referred to as a "radio identification tag information receiving unit" hereinafter) corresponding to a radio identification tag information receiver 217 of a color reader) is added. The other components are denoted by the same reference numerals as in the second embodiment, and a repetitive explanation thereof will be omitted.

Figure 22:
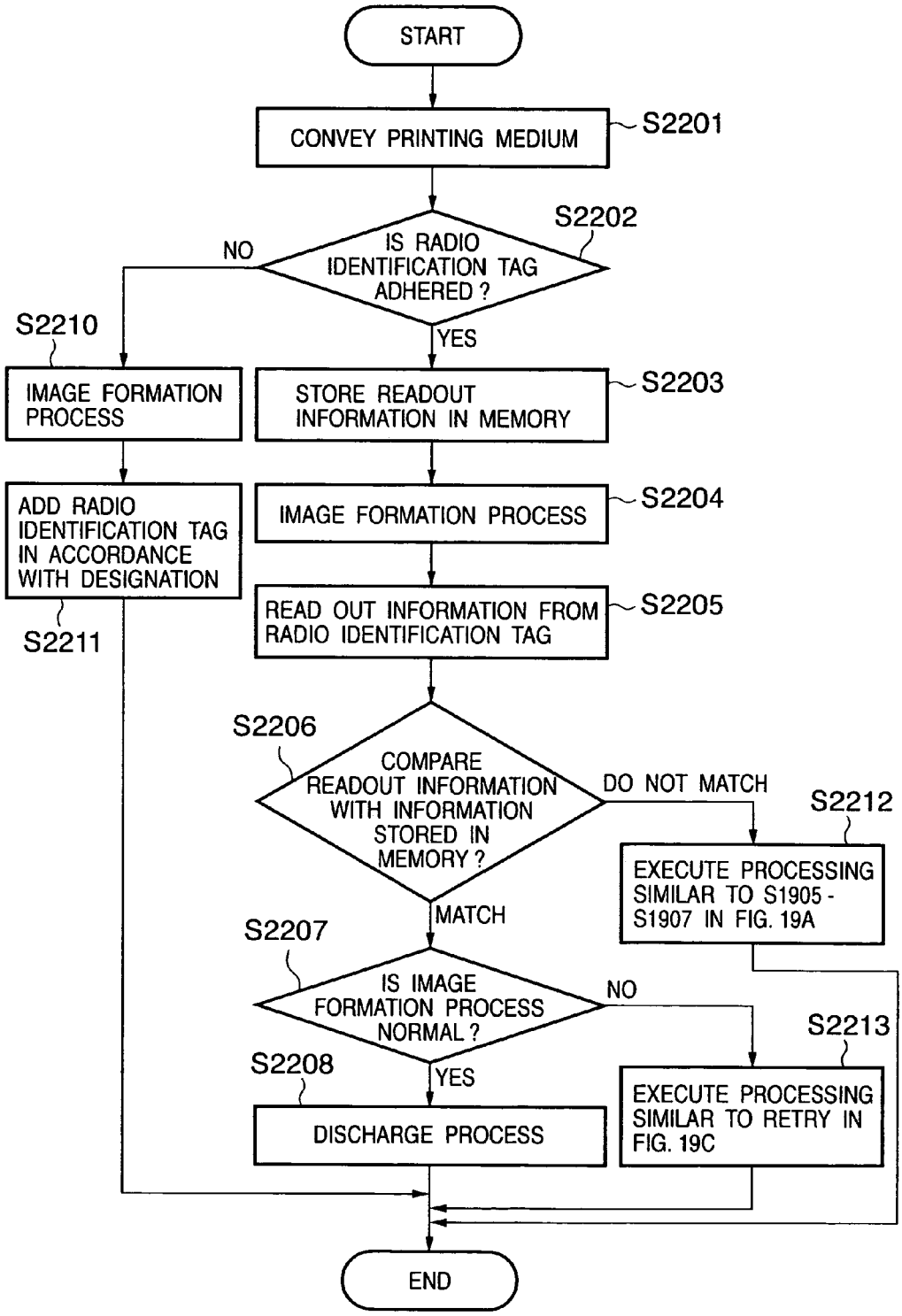
FIG. 22 is a view for explaining the flow of processing in the image forming apparatus according to the third embodiment.

FIG. 22 is a flowchart showing the flow of processing according to the third embodiment. The contents of this embodiment will be described below with reference to FIGS. 21 and 22.

In step S2201, conveyance of a printing medium is started. Printing media stored in cassettes (240 and 241) and a manual paper feed unit 253 are conveyed one by one onto a paper feed path by pickup rollers (238, 239, and 254). The radio identification tag information receiving unit 350 is placed on this convey path. So, whether a radio identification tag is adhered to the conveyed printing medium can be determined during conveyance.

In step S2202, whether a radio identification tag is adhered to the printing medium is determined by using the radio identification tag information receiving unit 350. In this determination, information written in a radio identification tag is read out on the printing medium convey path. If this information written in a radio identification tag can be read out, a CPU 391 determines that a radio identification tag is adhered to the printing medium. If the information can be read out, the CPU 391 stores the readout information in a memory 393 (step S2203). If no information can be read out in step S2202, the CPU 391 advances the flow to step S2110 to execute a normal image formation process. It is possible to adhere, in accordance with user's designation, a radio identification tag on the printing medium having undergone this image formation process, and write predetermined management information (S2111). The way the radio identification tag is adhered on the printing medium on which an image is formed is already described in the previous embodiments, so a detailed explanation thereof will be omitted.

In step S2204, predetermined image formation is performed on the printing medium on which the radio identification tag is adhered. In step S2205, a radio identification tag information reading/writing device 309 reads out the information of the radio identification tag at the timing at which the printing medium having undergone the image processing is discharged to a paper discharge tray, and transmits the result to the CPU 391.

In step S2206, the CPU 391 compares the information read out by the radio identification tag information reading/writing device 309 with the information written in the memory 393 by the radio identification tag information receiving unit 350. If the two pieces of information match, the CPU 391 determines that the radio identification tag is normally operating (not destroyed during the course of image formation), and advances the flow to step S2207. If the two pieces of information do not match, the flow advances to step S2212.

In step S2207, if the information read out by the radio identification tag information receiving unit 350 contains information concerning control of the image forming apparatus, the CPU 391 determines, on the basis of data loaded by a scanner 308, whether the results of the image formation process match, for example, the size and material of the printing medium pertaining to control. If the information such as the size of the printing medium does not match the information of the radio identification tag, the CPU 391 determines that some abnormality has occurred in the printing medium itself during the course of image formation, and advances the flow to step S2213.

Since it is determined in step S2206 that the radio identification tag normally functions, no new radio identification tag is adhered to the printing medium in step S2207, and a discharge process of discharging the printing medium onto a paper discharge tray 303 for normal printing media is immediately executed (S2208). During this process, the CPU 391 controls paper discharge rollers 310 and 311 and a motor 317 so that conveyance of the printing medium and positioning (adjustment of the height in the z direction) of the paper discharge tray 303 are performed in synchronism with each other.

In step S2212, no new radio identification tag is adhered, and processing similar to that processing (S1905 to S1907) explained in FIG. 19A of the second embodiment, which is performed if the image processing for the printing medium is not normal, is executed.

In step S2213, processing similar to the retry process explained in FIG. 19C of the second embodiment is executed. In this processing, information can be written again in the radio identification tag presently adhered on the printing medium, or a new radio identification tag can be adhered on the printing medium.

Other Embodiment

In the above embodiments, a radio identification tag is adhered to a printing medium by using an adhesive as shown in FIG. 11. However, the method of adhering a radio identification tag is not limited to this method. For example, it is also possible to apply a resin or the like between a film on which a radio identification tag is deposited and a printing medium, and adhere the radio identification tag by thermally fusing this resin or the like.

Also, in the above embodiments, the radio identification tag information receiver 217 is installed as an internal constituent element of the color reader, and information written in a radio identification tag is read out in synchronism with image data read. However, the present invention is not limited to this arrangement. For example, the radio identification tag information receiver 217 may also be installed as a read unit separated from the image forming apparatus. In this case, it is also possible to use the radio identification tag information receiver 217 as an independent read unit for reading out information stored in radio identification tag, separately from the image data copying process, and combine this unit with a unit for retrieving digital data on the basis of the readout information.

In the embodiments of the present invention as described above, a radio identification tag including a nonvolatile memory is attached, in synchronism with image formation, to a printing medium on which the image is formed, and information for managing the image is stored in the nonvolatile memory of the radio identification tag. In this manner, the image formed on the printing medium can be related to information unitarily managed in a database. This makes it possible to retrieve and reuse the original image data.

The present invention is also applicable to a facsimile apparatus as an image forming apparatus other than a copying machine, and to an apparatus having a plurality of functions. Also, the purpose of the present invention is achieved when a computer (or a CPU or MPU) of an apparatus reads out a control program module from a control program which implements the functions of the above embodiments, or from a recording medium storing the program, and executes the readout control program module. In this case, the control program module itself implements the functions of the above embodiments, and constitutes the present invention.

As the recording medium for supplying the control program module, it is possible to use, for example, a floppy (registered trademark) disk, hard disk, optical disk, magnetooptical disk, CD-ROM, CD-R, magnetic tape, nonvolatile memory card, and ROM.

As many apparently widely different embodiments of the present invention can be made without departing from the spirit and scope thereof, it is to be understood that the invention is not limited to the specific embodiments thereof except as defined in the appended claims.

What is claimed is:

1. An image forming apparatus by which an image formed on a printing medium by image forming means on the basis of image data can be related to the image data, comprising:

control means for preparing management information corresponding to the image data, and controlling an operation of said image forming means in accordance with the management information;

adhering means for adhering, to the printing medium on which the image is formed by said image forming means, a radio identification tag having a transmitting/receiving unit capable of transmitting/receiving data by radio communication, and a data holding unit capable of holding the data;

communicating means for writing, in said data holding unit of said radio identification tag adhered on the printing medium, the management information for relating the image on the printing medium to the image data, by communicating with said transmitting/receiving unit by radio; and determining means for determining whether the image formed on the printing medium by said image forming means has abnormality, wherein if the image is found to have no abnormality on the basis of the determination by said determining means, said adhering means adheres said radio identification tag to the printing medium, and wherein if the image is found to have abnormality on the basis of the determination by said determining means, said control means causes said image forming means to reexecute an image forming process.

2. The apparatus according to claim 1, wherein said communicating means can read out the management information written by radio communication from said data holding unit of said radio identification tag adhered to the printing medium.

3. The apparatus according to claim 1, wherein to prepare for the management information, said control means communicates with external storage means in accordance with an operation input, and receives predetermined management information stored in said external storage means.

4. The apparatus according to claim 3, wherein said control means compares the management information read out by said communicating means with the management information received by said control means from said external storage means, and determines which of the two pieces of management information is older.

5. The apparatus according to claim 4, wherein on the basis of the determination result, said communicating means writes the new management information in said data holding unit of said radio identification tag by radio communication.

6. The apparatus according to claim 3, wherein said control means receives image data corresponding to the management information read out by said communicating means from said external storage means storing the image data, and allows said image forming means to process the received image data.

7. The apparatus according to claim 1, wherein if the management information contains information for inhibiting processing for forming the image data, said control means inhibits said image forming means from processing the image data.

8. The apparatus according to claim 1, further comprising positioning means for positioning said adhering means and conveying the printing means, wherein said positioning means determines an adhesion position of said radio identification tag by synchronizing positioning of said adhering means with conveyance of the printing medium in accordance with a type of the printing medium or an operation input value.

9. The apparatus according to claim 8, wherein said positioning means determines a region where no image is formed on the printing medium, as the adhesion position of said radio identification tag.

10. The image forming apparatus according to claim 1, further comprising:

identifying means for identifying whether said radio identification tag is adhered to the printing medium before processing of said image forming means is performed, on the basis of whether management information can be read out by communicating with said transmitting/receiving unit of said radio identification tag; and storage means for storing the management information read out by said identifying means, wherein said communicating means reads out, by radio communication, the management information written in said data holding unit of said radio identification tag on the printing medium processed by said image forming means, and said control means determines whether said radio identification tag is normal by comparing the readout management information with the management information stored in said storage means.

11. The apparatus according to claim 1, wherein said adhering means adheres said radio identification tag to the printing medium via a staple for stapling the printing medium.

12. The apparatus according to claim 1, wherein said adhering means adheres said radio identification tag to the printing medium via a film on which said radio identification tag is formed.

13. A method of controlling an image forming apparatus by which an image formed on a printing medium by image forming means on the basis of image data can be related to the image data, comprising:

a control step of preparing management information corresponding to the image data, and controlling an operation of the image forming means in accordance with the management information;

an adhesion step of adhering, to the printing medium on which the image is formed by the image forming means, a radio identification tag having a transmitting/receiving unit capable of transmitting/receiving data by radio communication, and a data holding unit capable of holding the data;

a communication step of writing, in the data holding unit of the radio identification tag adhered on the printing medium, the management information for relating the image on the printing medium to the image data, by communicating with the transmitting/receiving unit by radio; and a determining step of determining whether the image formed on the printing medium by the image forming means has abnormality, wherein if the image is found to have no abnormality on the basis of the determination in said determining step, the radio identification tag is adhered to the printing medium in said adhesion step, and wherein if the image is found to have abnormality on the basis of the determination in said determining step. the image forming means is caused to reexecute an image forming process.

14. A control program of an image forming apparatus by which an image formed on a printing medium by image forming means on the basis of image data can be related to the image data, comprising:

a control module which prepares management information corresponding to the image data, and controls an operation of said image forming means in accordance with the management information;

an adhering module which adheres, to the printing medium on which the image is formed by said image forming means, a radio identification tag having a transmitting/receiving unit capable of transmitting/receiving data by radio communication, and a data holding unit capable of holding the data;

a communicating module which writes, in said data holding unit of said radio identification tag adhered on the printing medium, the management information for relating the image on the printing medium to the image data, by communicating with said transmitting/receiving unit by radio; and a determining module which determines whether the image formed on the printing medium by said image forming means has abnormality, wherein if the image is found to have no abnormality on the basis of the determination by said determining module, said adhering module effects adhering of said radio identification tag to the printing medium, and wherein if the image is found to have abnormality on the basis of the determination by said determining module, said control module causes said image forming means to reexecute an image forming process.

15. A computer-readable recording medium storing the control program recited in claim 14.

* * * * *

UNITED STATES PATENT AND TRADEMARK OFFICE

CERTIFICATE OF CORRECTION

PATENT NO. : 7,341,326 B2
APPLICATION NO. : 10/875201
DATED : March 11, 2008
INVENTOR(S) : Shunsaku Kondo et al.

It is certified that error appears in the above-identified patent and that said Letters Patent is hereby corrected as shown below:

COLUMN 28:

Line 25, “step.” should read -- step, --.

Signed and Sealed this

Twelfth Day of August, 2008

JON W. DUDAS
*Director of the United States Patent and Trademark Office*